US008720541B2

(12) United States Patent
Ellis et al.

(10) Patent No.: US 8,720,541 B2
(45) **Date of Patent: *May 13, 2014**

(54) TUBULAR HANDLING DEVICE AND METHODS

(75) Inventors: Brian Ellis, Houston, TX (US); Craig Weems, Houston, TX (US); Faisal J. Yousef, Houston, TX (US); Beat Küttel, Spring, TX (US)

(73) Assignees: Canrig Drilling Technology Ltd., Houston, TX (US); First Subsea Limited (GB)

( * ) Notice: Subject to any disclaimer, the term of this patent is extended or adjusted under 35 U.S.C. 154(b) by 371 days.

This patent is subject to a terminal disclaimer.

(21) Appl. No.: 12/982,644

(22) Filed: Dec. 30, 2010

(65) Prior Publication Data

US 2011/0147010 A1 Jun. 23, 2011

Related U.S. Application Data

(63) Continuation-in-part of application No. 12/147,223, filed on Jun. 26, 2008, now Pat. No. 8,047,711.

(51) Int. Cl.
*E21B 19/16* (2006.01)

(52) U.S. Cl.
USPC ..... 166/77.51; 166/77.1; 166/77.52; 166/77.53; 166/380

(58) Field of Classification Search
USPC ..... 166/77.1, 77.51, 77.52, 77.53, 98, 166/379–380; 414/22.71, 23, 745.4, 746.5; 175/52, 85
See application file for complete search history.

(56) References Cited

U.S. PATENT DOCUMENTS

| | | | |
|---|---|---|---|
| 1,486,471 | A | 3/1924 | Wilcox |
| 1,829,760 | A | 11/1931 | Santiago |
| 1,917,699 | A | 7/1933 | Casablancas |
| 2,178,999 | A | 11/1939 | Scott |
| 2,203,118 | A | 6/1940 | Williams |

(Continued)

FOREIGN PATENT DOCUMENTS

| | | |
|---|---|---|
| CA | 2512570 | 1/2006 |
| GB | 2155577 | 9/1985 |

(Continued)

OTHER PUBLICATIONS

Det Norske Veritas, "Technical Report: BSW Limited Design and Engineering: Testing of Ballgrab Anchor Connector," Report No. 2002-3263, Jul. 31, 2002, http://www.ballgrab.co.uk/downloads/dnvfatiguereport.pdf.

(Continued)

*Primary Examiner* — James Sayre
(74) *Attorney, Agent, or Firm* — Haynes and Boone, LLP

(57) ABSTRACT

A tubular handling apparatus including a tubular member running tool adapted to provide load-bearing, and preferably torquing, capacity upon the gripping of a tubular is provided. The running tool includes a slotted member having a plurality of elongated slots, a recessed member associated with the slotted member and having a plurality of recesses, and a plurality of gripping elements disposed between the slotted member and recessed member. Each such gripping element is adapted to move with an engaged tubular so as to grip the tubular. A tubular member elevator associated to the running tool, as well as related floor slips, are also encompassed. Methods of casing running are also included.

11 Claims, 17 Drawing Sheets

(56) References Cited

U.S. PATENT DOCUMENTS

| | | | | |
|---|---|---|---|---|
| 2,211,016 | A | 8/1940 | Krell | |
| 2,775,304 | A | 12/1956 | Zandmer | |
| 3,522,966 | A | 8/1970 | Wood | |
| 3,540,533 | A | 11/1970 | Morrill | |
| 3,543,847 | A | 12/1970 | Haeber | |
| 3,897,099 | A | 7/1975 | Scodino et al. | |
| 4,114,404 | A | 9/1978 | Phelps | |
| 4,444,252 | A | 4/1984 | Fisher, Jr. | |
| 4,448,255 | A | 5/1984 | Shaffer et al. | |
| 4,643,472 | A | 2/1987 | Schukei et al. | |
| 4,647,099 | A | 3/1987 | Berry et al. | |
| 4,793,422 | A | 12/1988 | Krasnov | |
| 4,811,784 | A | 3/1989 | Theiss | |
| 4,971,146 | A | 11/1990 | Terrell | |
| 5,082,061 | A | 1/1992 | Dollison | |
| 5,125,148 | A | 6/1992 | Krasnov | |
| 5,330,002 | A | 7/1994 | Saunders | |
| 5,340,182 | A | 8/1994 | Busink et al. | |
| 5,484,222 | A | 1/1996 | Schulze-Beckinghausen | |
| 5,553,667 | A | 9/1996 | Budde et al. | |
| 5,749,585 | A | 5/1998 | Lembcke | |
| 5,967,477 | A * | 10/1999 | Walmsley | 248/230.2 |
| 6,302,199 | B1 | 10/2001 | Hawkins et al. | |
| 6,305,649 | B1 | 10/2001 | Walmsley et al. | |
| 6,352,115 | B1 | 3/2002 | Mathieu | |
| 6,354,372 | B1 | 3/2002 | Carisella et al. | |
| 6,443,241 | B1 | 9/2002 | Juhasz et al. | |
| 6,536,520 | B1 | 3/2003 | Snider et al. | |
| 6,550,128 | B1 | 4/2003 | Lorenz | |
| 6,557,641 | B2 | 5/2003 | Sipos et al. | |
| 6,591,904 | B2 | 7/2003 | Cicognani | |
| 6,609,573 | B1 | 8/2003 | Day | |
| 6,622,796 | B1 | 9/2003 | Pietras | |
| 6,622,797 | B2 | 9/2003 | Sivley, IV | |
| 6,637,526 | B2 | 10/2003 | Juhasz et al. | |
| 6,644,413 | B2 | 11/2003 | Adams et al. | |
| 6,679,333 | B2 | 1/2004 | York et al. | |
| 6,681,861 | B2 | 1/2004 | Davidson et al. | |
| 6,688,398 | B2 | 2/2004 | Pietras | |
| 6,691,776 | B2 | 2/2004 | Guillory et al. | |
| 6,695,050 | B2 | 2/2004 | Winslow et al. | |
| 6,705,405 | B1 | 3/2004 | Pietras | |
| 6,719,063 | B2 | 4/2004 | Adams et al. | |
| 6,742,596 | B2 | 6/2004 | Haugen | |
| 6,752,569 | B2 | 6/2004 | Emmett | |
| 6,779,614 | B2 | 8/2004 | Oser | |
| 6,814,140 | B2 | 11/2004 | Robichaux | |
| 6,854,515 | B2 | 2/2005 | Matthews et al. | |
| 6,857,483 | B1 | 2/2005 | Dirks et al. | |
| 6,913,096 | B1 | 7/2005 | Nielsen et al. | |
| 6,920,926 | B2 | 7/2005 | York et al. | |
| 6,938,709 | B2 | 9/2005 | Juhasz et al. | |
| 6,966,385 | B2 | 11/2005 | Hemphill et al. | |
| 6,976,298 | B1 | 12/2005 | Pietras | |
| 6,991,265 | B2 | 1/2006 | Walmsley et al. | |
| 7,004,259 | B2 | 2/2006 | Pietras | |
| 7,021,374 | B2 | 4/2006 | Pietras | |
| 7,055,609 | B2 | 6/2006 | Hayes et al. | |
| 7,073,598 | B2 | 7/2006 | Haugen | |
| 7,090,021 | B2 | 8/2006 | Pietras | |
| 7,096,977 | B2 | 8/2006 | Juhasz et al. | |
| 7,128,161 | B2 | 10/2006 | Pietras | |
| 7,134,531 | B2 | 11/2006 | Ramey et al. | |
| 7,137,454 | B2 | 11/2006 | Pietras | |
| 7,140,443 | B2 | 11/2006 | Beierbach et al. | |
| 7,191,840 | B2 | 3/2007 | Pietras et al. | |
| 7,217,056 | B2 | 5/2007 | Cooper | |
| 7,325,610 | B2 | 2/2008 | Giroux et al. | |
| 7,350,586 | B2 | 4/2008 | Guidry | |
| 7,353,026 | B2 | 4/2008 | Lee | |
| 7,370,707 | B2 | 5/2008 | McDaniel et al. | |
| 7,377,324 | B2 | 5/2008 | Beierbach et al. | |
| 7,438,127 | B2 | 10/2008 | Lesko | |
| 7,445,050 | B2 * | 11/2008 | Kuttel et al. | 166/380 |
| 7,552,764 | B2 * | 6/2009 | Weems et al. | 166/85.1 |
| 8,146,671 | B2 * | 4/2012 | Sipos | 166/380 |
| 8,186,246 | B2 * | 5/2012 | Niven | 81/57.16 |
| 2001/0042625 | A1 | 11/2001 | Appleton | |
| 2002/0070027 | A1 | 6/2002 | Ohmer et al. | |
| 2003/0000708 | A1 | 1/2003 | Coone | |
| 2003/0127222 | A1 | 7/2003 | Marcin et al. | |
| 2003/0173073 | A1 | 9/2003 | Snider et al. | |
| 2003/0196791 | A1 | 10/2003 | Dunn et al. | |
| 2004/0084191 | A1 | 5/2004 | Laird | |
| 2004/0216924 | A1 | 11/2004 | Pietras et al. | |
| 2005/0061548 | A1 | 3/2005 | Hooper et al. | |
| 2005/0160881 | A1 | 7/2005 | Niven | |
| 2006/0000600 | A1 | 1/2006 | Pietras et al. | |
| 2006/0011353 | A1 * | 1/2006 | Pietras | 166/379 |
| 2006/0102337 | A1 | 5/2006 | Elliot et al. | |
| 2007/0074876 | A1 | 4/2007 | Pietras | |
| 2007/0251700 | A1 | 11/2007 | Mason et al. | |
| 2007/0261857 | A1 | 11/2007 | Kuttel et al. | |
| 2008/0164693 | A1 | 7/2008 | Weems et al. | |
| 2009/0056930 | A1 * | 3/2009 | Angelle et al. | 166/77.51 |
| 2009/0101361 | A1 | 4/2009 | Mason et al. | |
| 2009/0321064 | A1 | 12/2009 | Ellis et al. | |

FOREIGN PATENT DOCUMENTS

| | | |
|---|---|---|
| WO | WO 2007/124418 A3 | 11/2007 |
| WO | WO 2007/127737 A3 | 11/2007 |
| WO | WO 2009/025832 | 2/2009 |
| WO | WO 2011/056163 | 5/2011 |

OTHER PUBLICATIONS

European Patent Office, "International Search Report—PCT/US2009/048507," mailed Feb. 1, 2010.

European Patent Office, "Written Opinion of the International Searching Authority—PCT/US2009/048507," mailed Feb. 1, 2010.

* cited by examiner

TUBULAR HANDLING DEVICE AND METHODS

CROSS-REFERENCE TO RELATED APPLICATIONS

This is a continuation-in-part of co-pending U.S. application Ser. No. 12/147,223, filed Jun. 26, 2008, the contents of which is hereby incorporated herein in its entirety by express reference thereto.

BACKGROUND

The drilling of subterranean wells involves assembling tubular strings, such as casing strings and drill strings, each of which comprises a plurality of heavy, elongated tubular segments extending downwardly from a drilling rig into a wellbore. The tubular string consists of a number of threadedly engaged tubular segments.

Conventionally, workers use a labor-intensive method to couple tubular segments to form a tubular string. This method involves the use of workers, typically a "stabber" and multiple operators, such as tong operators. The stabber is placed in an elevated position within the derrick on a stabbing board to manually align a single tubular segment with the existing tubular string. This is an inherently unsafe position due to the height at which the stabber is placed, as well as the number and multitude of moving parts within the derrick. Various operators ensure the alignment and connection of the single tubular segment to the existing tubular string on the floor of the derrick. The tong operators engage the tongs to rotate the tubular segment, threadedly connecting it to the tubular string. While such a method is effective, it is dangerous, cumbersome and inefficient. Additionally, the tongs require multiple workers for proper engagement of the tubular segment and to couple the tubular segment to the tubular string. Thus, such a method is labor-intensive and therefore costly. Furthermore, using tongs can require the use of scaffolding or other like structures, which endangers workers.

Others have proposed a running tool utilizing a conventional top drive assembly for assembling tubular strings. The running tool includes a manipulator, which engages a tubular segment and raises the tubular segment up into a power assist elevator, which relies on applied energy to hold the tubular segment. The elevator couples to the top drive, which rotates the elevator. Thus, the tubular segment contacts a tubular string and the top drive rotates the tubular segment and threadedly engages it with the tubular string.

While such a tool provides benefits over the more conventional systems used to assemble tubular strings, it also suffers from shortcomings. One such shortcoming is that the tubular segment might be scarred by the elevator gripping dies. Another shortcoming is that a conventional manipulator arm cannot remove single joint tubulars and lay them down on the pipe deck without worker involvement.

Other tools have been proposed to cure these shortcomings. However, such tools are often unable to handle tubulars that are dimensionally non-uniform. When the tubulars being handled are not dimensionally ideal, such as by having a varying wall thickness or imperfect cylindricity or circularity, the ability of tools to adequately engage the tubulars is decreased.

SUMMARY OF THE INVENTION

The present invention can provide distinct advantages, including eliminating the need for the use of a stabber, thereby increasing the safety of the oil rig, as well as limiting or eliminating the scarring or deformation of the tubulars when placed within the running tool of the present invention, as compared to traditional tools.

The present invention encompasses a tubular handling apparatus including a tubular running tool that includes a slotted member having a plurality of elongated slots each extending at least partially in a direction substantially parallel to a longitudinal axis of a tubular to be handled, a recessed member operably associated with the slotted member and having a plurality of recesses in a surface thereof that each extend between a deep end and a shallow end, and a plurality of sliding members operably associated with the plurality of elongated slots and the plurality of recesses adapted to move in the same direction as a tubular in contact therewith so that the tool grips the tubular, and a tubular member elevator adapted to operatively associate a tubular with the tubular running tool, wherein the tubular running tool is adapted to grip each tubular to provide load-bearing capacity to inhibit or prevent the tubular or a tubular string attached thereto from dropping independent of the operation of the tubular member elevator.

In at particular embodiment, the tubular member elevator is coupled to the tubular running tool and is adapted to transfer one or more tubulars (e.g., one, two, or even three at a time) between a tubular supply and the tubular running tool.

In further embodiments, the tubular running tool and tubular member elevator are coupled through no more than a pair of actuators. In some embodiments, the no more than a pair of actuators is operably associated with linking elements that facilitate positioning of the tubular within the running tool. In other embodiments, there may be two pairs of actuators, a single actuator, or other amounts or even different types of actuators.

In one aspect of the invention, the plurality of sliding members each retract at least partially into a corresponding recess when the tubular handling apparatus is in a gripping position to grip a tubular.

In one embodiment, the tubular handling apparatus further includes a pre-load mechanism that reversibly exerts force on the tubular when engaged in the tubular running tool so as to grip the tubular. Release of this pre-load force, optionally with an additional release force in a different direction being applied, terminates the gripping.

In accordance with another embodiment of the invention, there is provided a method of handling a tubular during a casing or drilling operation which includes engaging a surface portion of a tubular with a tubular member elevator, operating the tubular member elevator to position the tubular to be manipulated by a running tool, and engaging at least a second, different surface portion of the tubular with a portion of the running tool so as to retain the tubular due to the downward force created by the weight of the tubular or a tubular string attached thereto interacting with the portion of the running tool at the second, different surface portion.

In some embodiments, this method further includes disengaging the tubular member elevator subsequent to engaging and retaining the tubular with the running tool. In some instances, the disengagement of the tubular member elevator occurs automatically in automated fashion without further human intervention after a gripping position has been achieved by the running tool.

In some embodiments, this method further includes lowering the tubular gripped by the running tool onto a load-bearing surface to further urge an end of the tubular into a recess in the running tool. This can advantageously position a gripping apparatus of the running tool in an engagement position so as to be able to grip the tubular.

In accordance with another broad aspect of the invention, there is provided a method of handling a tubular in a casing or drilling operation, including: operating the running tool to interact with and grip a tubular section including one to three tubulars, applying a rotational force to the tubular section, at least one surface of which is engaged with and gripped by a portion of the running tool, to at least partially disconnect the tubular section or a portion thereof, operating the tubular member elevator to interact with and grip the tubular section or a portion thereof, and raising the tubular section relative to the running tool to separate the tubular section from the tubular string and to disengage the engaged and gripped surface of the tubular section from the portion of the running tool. In one embodiment, the method further includes lowering the running tool and concurrently raising the tubular section a relatively greater amount than the running tool is lowered to ensure separation of the tubular section form any tubular string remaining.

In accordance with another broad aspect of the invention, there is provided a method of handling a tubular in a casing or drilling operation which includes: operating the running tool to interact with a tubular section comprising one to three tubulars, applying a rotational force to the tubular section, at least one surface of which is engaged with and gripped by a radially-shaped bowl portion of the running tool, to at least partially disconnect a tubular section from a tubular string, operating a tubular member elevator to interact with and grip the tubular section or a portion thereof, and moving the bowl portion of the running tool in a direction having at least an axial component along the gripped tubular section to disengage the bowl portion of the running tool from at least one surface portion of the tubular section. The radially-shaped bowl portion can include sections or portions of each of the rolling or sliding members, the recesses and the slots. In one embodiment, the method further includes removing the tubular section entirely from the tubular handling apparatus.

In accordance with another broad aspect of the invention, there is provided a tubular running tool including: a slotted member having a plurality of elongated slots each extending at least partially in a direction substantially parallel to a longitudinal axis of a tubular to be handled, a recessed member operably associated with the slotted member having a plurality of recesses wherein the recesses extend from a deep end to a shallow end, and a plurality of sliding members operatively associated with the plurality of elongated slots and the plurality of recesses, wherein a gripping portion of the running tool is configured to frictionally engage at least one surface of a tubular sufficient to apply a torque to the tubular solely through the gripping portion.

In some embodiments, the plurality of elongated slots are fixed relative to the plurality of recesses. In further embodiments, the running tool is configured to frictionally engage an inner surface of a tubular. In some embodiments, the plurality of sliding elements each retract partially into a corresponding slot and recess when the tubular handling apparatus is in a released position so as not to grip a tubular. In other embodiments, the plurality of sliding elements grip a tubular upon the motion of the tubular away from the running tool. In yet still other embodiments, the tubular running tool is operatively associated with a handling mechanism that is adapted to feed a tubular into, or remove a tubular from, the running tool so as to facilitate iterative loading of the running tool with a further tubular.

In accordance with another broad aspect of the invention, there is provided a tubular member elevator, including a slotted elevator component having a plurality of elongated slots each extending at least partially in a direction substantially parallel to a longitudinal axis of a tubular to be handled, a recessed elevator component operably associated with the slotted elevator member and having a plurality of elevator recesses in a surface thereof that extend between a deep end to a shallow end, and a plurality of sliding or rolling elevator components, or both, operatively associated with a corresponding one of the elongated elevator slots and one of the elevator recesses, wherein each of the plurality of sliding or rolling elevator components, or both retracts at least partially within the slotted elevator member when displaced away from the shallow end of the corresponding elevator recess.

In some embodiments, the tubular member elevator is a single, double or triple joint elevator. In other embodiments, the plurality of sliding or rolling elevator components, or both, retracts at least partially into at least one slot of the slotted elevator component when the elevator is gripping a tubular. In further embodiments, the tubular member elevator is coupled to a running tool through one or more actuators free of linking elements. In other embodiments, the tubular member elevator is adapted to move a tubular through a linear retraction device.

In accordance with another broad aspect of the invention, there is provided a floor slip adapted to hold a tubular or tubular string including a slotted floor slip component having a plurality of elongated slots each extending at least partially in a direction substantially parallel to a longitudinal axis of a tubular to be handled, a recessed floor slip component operably associated with the slotted floor slip member and having a plurality of floor slip recesses in a surface thereof that extend between a deep end to a shallow end, and a plurality of floor slip gripping components (e.g., rolling or sliding, or both) each operatively associated with a corresponding one of the elongated floor slip slots and one of the floor slip recesses, wherein each of the plurality of floor slip gripping components retracts within at least a portion of the slotted floor slip component when displaced away from the shallow end of the corresponding floor slip recess.

In some embodiments, the floor slip is reversibly coupled to a rig floor. In other embodiments, the floor slip is positioned so that it can be permanently attached to the rig floor. In further embodiments, each of the plurality of floor slip components is configured to retract at least partially into at least one slot of the slotted floor slip component when the floor slip is in a gripping position to grip a tubular or tubular string, while in other embodiments, the floor slip components only retract partially so that a portion still extends from the recess beyond and through the slotted floor slip component. In yet still further embodiments, the floor slip is adapted to provide load-bearing capacity for a tubular or tubular string suspended therefrom. In other embodiments, a portion of the floor slip is adapted to reversibly couple and rotate when gripping a tubular or tubular string being rotated. In some embodiments, the floor slip is hydraulically or pneumatically operated between a gripped position and a released position. The floor slips may further include a latching mechanism to lock the floor slip around the tubular or tubular string. In some embodiments, the floor slip further includes a centering mechanism to facilitate centering of the tubular string adjacent the wellbore center. In yet other embodiments, the floor slip further includes an interlock system adapted to prevent release of one or more tubulars being gripped by the floor slip until the one or more tubulars confirmed as being gripped by an operatively associated running tool or tubular member elevator.

The invention also encompasses methods of connecting and disconnecting tubulars with a floor slip that includes the gripping assembly described herein.

It is to be understood that other aspects of the present invention will become readily apparent to those of ordinary skill in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION OF PREFERRED EMBODIMENTS

Figure 1A:
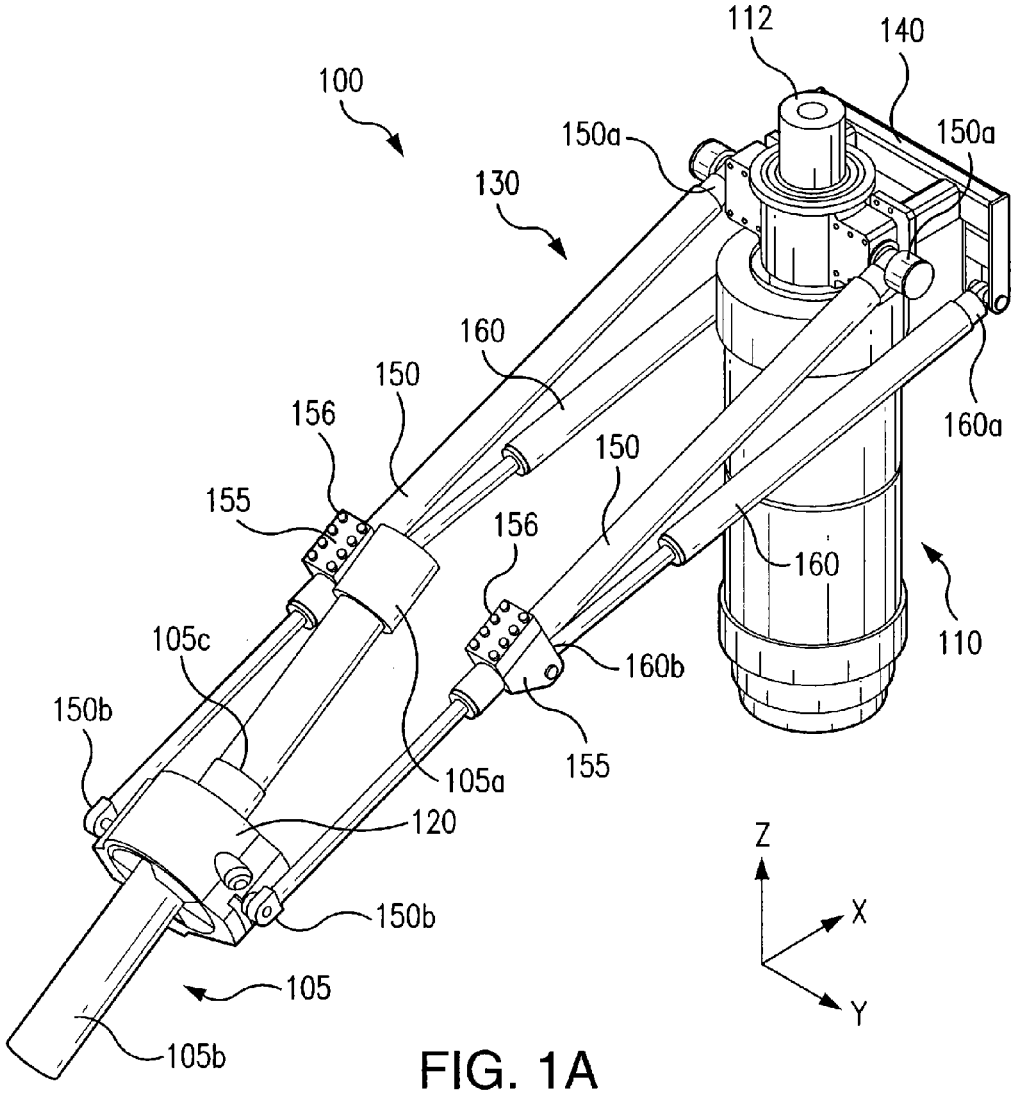
FIG. 1A is a perspective view of at least a portion of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Throughout the specification, the terms "tubular" and "tubular member" are typically used interchangeably.

Referring to FIG. 1, illustrated is a perspective view of at least a portion of a tubular handling apparatus 100 according to one or more aspects of the present disclosure. The apparatus 100 comprises a tubular running tool 110, a tubular member elevator 120, and, in some embodiments, a link tilt assembly 130.

The tubular running tool 110 is configured to receive and at least temporarily grip, frictionally engage, or otherwise retain a tubular 105. For example, the tubular running tool 110 may be configured to engage and grip an interior surface of the tubular 105, an exterior surface of the tubular 105, or both an interior surface and an exterior surface of the tubular 105, or portions thereof. The extent to which the running tool 110 frictionally engages and retains the tubular 105 may be able to provide load-bearing capacity upon gripping the tubular to inhibit or prevent a tubular or tubular string from dropping, independently of the operation of an associated tubular member elevator or optional associated floor slips. The running tool 110 may be sufficient to support a safe working load (SWL) of about at least 5 tons. Other SWL values for the running tool 110 are also within the scope of the present disclosure, and it is contemplated that the running tool 110 can support an entire tubular string of substantially greater weight to lower the tubular string for gripping by one or more floor slips or other gripping devices. The gripping apparatus discussed herein with respect to the running tool is also equally applicable to, and adapted for operation in connection with, a tubular member elevator, a floor slip gripping apparatus, or any combination thereof so that the gripping apparatus or gripping assembly herein can form part of the running tool, tubular member elevator, and floor slip.

The extent to which the running tool 110 frictionally engages and grips (or retains) the tubular 105 may also but preferably be sufficient to impart a torsional force to the tubular 105, such as may be transmitted through the running tool 110 from a top drive or other component of the tubular string through the gripped portion of the tubular or otherwise. In an exemplary embodiment, the torque which may be applied to the tubular 105, preferably via the gripping elements of the running tool 110, is at least about 5000 ft-lbs, which may be sufficient to "make-up" a connection between the tubular 105 and another tubular member. The torque which may be applied to the tubular 105 may additionally or alternatively be at least about 50,000 ft-lbs, which may be sufficient to "break" a connection between the tubular 105 that is gripped by the running toll 110 and another attached tubular. Other torque values between about 100 ft-lbs and 80,000 ft-lbs or greater, preferably from about 1,000 ft-lbs to 50,000 ft-lbs, are also within the scope of the present disclosure. In one embodiment, torque values of greater than 50,000 ft-lbs to about 80,000 ft-lbs, preferably about 55,000 ft-lbs to 75,000 ft-lbs, and in another embodiment about 60,000 ft-lbs to 70,000 ft-lbs can be achieved, or any combination of these values greater than 50,000 ft-lbs.

The tubular 105 may be a wellbore casing member, a drill string tubing member, a pipe member, a collared tubing member, and/or other tubular elements or combinations thereof. The tubular 105 may be a single tubular section, or pre-assembled double or triple sections. In an exemplary embodiment, the tubular 105 may be or comprise one, two, or three sections of collared or integral joint or threaded pipe, such as may be utilized as a portion of a tubing, casing, or drill string. The tubular 105 may alternatively be or comprise a section of a pipeline, such as may be utilized in the transport of liquid and/or fluid materials. The tubular 105 may alternatively be or comprise one or more other tubular structural members. The tubular 105 may have an annulus cross-section having a substantially cylindrical, rectangular or other geometric shape.

In an exemplary embodiment, at least a portion of the running tool 110 is substantially similar to the tubular running tool or tubular handling apparatus described in commonly-assigned U.S. Pat. No. 7,445,050, entitled "Tubular Running Tool," filed Apr. 25, 2007, and/or U.S. Pat. No. 7,552,764, entitled "Tubular Handling Device," filed Jan. 4, 2007. For example, one or more operational principles, components, and/or other aspects of the gripping apparatus described in the above-incorporated references may be implemented within one or more embodiments of the running tool 110, tubular member elevator, or floor slip gripping assembly within the scope of the present disclosure.

The running tool 110 is configured to be engaged by, or otherwise interfaced with, a top drive or drill string section or component. For example, as schematically represented in the exemplary embodiment shown in FIG. 1A, the running tool 110 may comprise an interface 112 configured to mate, couple, or otherwise interface with the quill, housing, and/or other component of the top drive or component of the drill string. In an exemplary embodiment, the interface 112 comprises one half of a standard box-pin coupling commonly employed in drilling operations. In another exemplary embodiment, the running tool 110 is operatively associated with, directly or indirectly, such as by way of other connecting components, e.g., actuators and/or linking elements, coupled to the tubular member elevator 120. In some instances, the tubular running tool and the tubular member elevator are coupled through no more than a pair of actuators. The actuators may be operably associated with linking elements that allow for positioning of the tubular within the tubular running tool, and there may be one or more actuators. Other interfaces, however, are also within the scope of the present disclosure.

The tubular member elevator 120 may be a single, double or triple joint elevator, depending upon the type of rig and/or drilling or casing condition(s). The tubular member elevator 120 is also configured to receive and at least temporarily grip, frictionally engage, or otherwise retain the tubular 105. For example, the tubular member elevator 120 may be configured to grip or otherwise frictionally engage an interior surface of the tubular 105, an exterior surface of the tubular 105, or an interior surface and an exterior surface of the tubular 105, or portions thereof. The extent to which the elevator 120 frictionally engages or otherwise retains the tubular 105 may be sufficient to support a safe working load (SWL) of at least about 5 tons, or at least about 15 tons. However, other SWL values for the tubular member elevator 120 are also within the scope of the present disclosure, particularly within the weight for any available tubular.

In an exemplary embodiment, at least a portion of the tubular member elevator 120 is substantially similar to the tubular running tool or other handling apparatus described in commonly-assigned U.S. Pat. No. 7,445,050, entitled "Tubular Running Tool," filed Apr. 25, 2007, and/or U.S. Pat. No. 7,552,764, entitled "Tubular Handling Device," filed Jan. 4, 2007, or otherwise has one or more similar aspects or operational principles. The tubular member elevator 120 may alternatively comprise a series of shoes, pads, and/or other friction members such as wheels configured to radially constrict or contact a surface of the tubular 105 and thereby retain the tubular 105, among other configurations within the scope of the present disclosure. Preferably, this elevator member 120 contact surface is the outer surface of the tubular.

In other embodiments, the tubular member elevator 120 may have a similar configuration to the tubular running tool 110. The gripping assembly of the RT 110 may be adapted to and operatively associated with the tubular member elevator 120. In yet a further embodiment, the floor slips can be operatively associated with a substantially similar gripping assembly. For example, the tubular member elevator 120 may contain a slotted elevator component having a plurality of elongated slots each extending at least partially or entirely in a direction parallel or substantially parallel to a longitudinal axis of a tubular to be handled. The slots may be of any configuration such as, for example, circular, semi-circular, elliptical, rectangular, etc. In some embodiments, a recessed elevator component is operably associated with the slotted elevator member. The recessed elevator member may have a plurality of elevator recesses in its surface that extend between a deep end to a shallow end. These recesses preferably match up or align with the slots of the slotted elevator component. Also included in the tubular member elevator 120 are a plurality of rolling or sliding elevator components operatively associated with the plurality of slots and recesses. The plurality of rolling or sliding elevator components may retract within at least a portion of the slotted elevator member when located in the deep end of a corresponding elevator recess. Each of the rolling or sliding elevator components may retract at least partially, in some instances entirely, within a slot of the slotted elevator component when the elevator is gripping a tubular. When partially retracted, the elevator gripping components still extend partially from the recess through the slotted elevator member to engage, or contact, a tubular having an end disposed therein. In addition, the plurality of rolling or sliding elevator components may be exposed to the tubular surface when displaced from the deep end of a corresponding elevator recess. It should be understood that gripping elevator members may be rolling, sliding, or both.

Although both the running tool 110 and the tubular member elevator 120 are configured to engage the tubular 105, the running tool 110 is configured and/or controllable to engage typically an end portion 105*a* of the tubular 105 by the radial enlargement of the tubular member elevator and/or the running tool enabling the enlarged tubular element 105*a* to pass unimpeded into the running tool 110, whereupon the gripping elements of the tool are positioned to engage the pipe in the reduced portion 105*c*. However, the tubular member elevator 120 is configured and/or controllable to engage an axially-intermediate portion 105*b* of the tubular. For example, the running tool 110 may be configured to engage the radially enlarged shoulder often exhibited by conventional drilling joints, whereas the tubular member elevator 120 may be configured to engage the smaller diameter of the remaining length of the joint.

In one embodiment, the link tilt assembly 130 comprises a bracket 140, two actuators 150 each extending between the running tool 110 and the elevator 120, and two other actuators 160 each extending between the bracket 140 and a corresponding one of the actuators 150. An alternative approach could include a rotary actuator on the end of pivot 150*a* in conjunction with the linear actuator 150. The ends of each actuator 150, 160 may be configured to be rotatable, such as by comprising a structural loop or hook through which a pin or other coupling means may be secured. Thus, the ends 150*a* of the actuators 150 may be rotatably coupled to the running tool 110 or intermediate structure coupled to the running tool 110, and the opposing ends 150*b* of the actuators 150 may be rotatably coupled to the elevator 120 or intermediate structure coupled to the elevator 120. Similarly, the ends 160*a* of the actuators 160 may be rotatably coupled to the bracket 140, and the opposing ends 160*b* of the actuators 160 may be rotatably coupled to the actuators 150 or intermediate structure coupled to the actuators 150. In certain embodiments, there are pairs of actuators, such as two or four, while in others there is a single actuator and one or two pairs of linking elements. Other interfaces, however, are also within the scope of the present disclosure. In one embodiment, there are no linking elements between a lower portion of the tubular elevator member 120 and the top drive or running tool 110. The tubular elevator member 120 can operate through a retraction device, such as one or more wheels that can load and/or unload a tubular, or both, within a recess in the tubular elevator member 120.

In the exemplary embodiment shown in FIG. 1A, the end 160*b* of each actuator 160 is rotatably coupled to a corresponding bracket 155, which is positionally fixed relative to the corresponding actuator 150 at an intermediate position between the ends 150*a*, 150*b* of the actuator 150. Each bracket 155 may have a U-shaped profile or otherwise be configured to receive and rotatably couple with the end 160*b* of the corresponding actuator 160. The brackets 155 may be coupled to the corresponding actuator 150 via one or more bolts 156, as shown in FIG. 1A, although other fastening means may also be employed.

The end points 160*a* of the actuators 160 are offset from the end points 150*a* of the actuators 150 such that the extension and retraction of the actuators 160 operates to rotate the actuators 150 relative to the running tool 110. For example, the end points 160*a* are each offset from the associated end points 150*a* in both the X and Z directions according to the coordinate system depicted in FIG. 1A. In other embodiments, however, the end points 160*a* may each be offset from the associated end points 150*a* in only one of the X and Z directions while still being configured to enable rotation of the actuators 150 relative to the running tool 110 (i.e., rotation about an axis extending through both end points 150*a* and parallel to the Y-axis of the coordinate system shown in FIG. 1A).

Each of the actuators 150 and the actuators 160 may be or comprise a linearly actuated cylinder which is operable hydraulically, electrically, mechanically, pneumatically, or via a combination thereof. In the exemplary embodiment shown in FIG. 1A, each actuator 150, 160 comprises a cylindrical housing from which a single cylindrical rod (e.g., a piston) extends. In other embodiments, however, one or more of the actuators 150, 160 may comprise a multi-stage actuator comprising more than one housing and/or cylinder, perhaps in a telescoping configuration, thus enabling a greater amount of travel and/or a more compact solution, among other possible advantages. A telescoping configuration may permit the apparatus to operate with one or more actuators removed, preferably a pair of actuators (e.g., 150) (not shown).

In the illustrated embodiment, each actuator 150 comprises a cylinder coupled to the running tool 110, wherein a rod extends from the cylinder and is rotatably coupled to the elevator 120. In addition, each actuator 160 comprises a cylinder coupled to the bracket 140 of the running tool 110, wherein a rod extends from the opposite end of the cylinder and is rotatably coupled to the corresponding bracket 155. Each bracket 155 is coupled to the cylinder of the corresponding actuator 150 near the end of the cylinder from which the rod extends. However, other configurations of the link tilt assembly 130 are also within the scope of the present disclosure.

The configuration depicted in FIG. 1A may be that of an initial or intermediate stage of preparing the tubular for assembly into the tubular string. Thus, the actuators 160 may have been extended to rotate the actuators 150 away from the centerline of the tubular string, and the actuators 150 may have been extended to initially position the elevator 120 around the axially intermediate portion 105*b* of the tubular 105. In practice, each tubular 105 may have an elevator gripping limit 105*c* defining the axially intermediate portion 105*b* within which the tubular member elevator 120 should be positioned prior to gripping the tubular 105. In some embodiments, operating the tubular member elevator 120 to grip the tubular 105 beyond the limit 105*c* (i.e., too close to the end 105*a*), may mechanically damage the tubular 105, thus reducing its operational life. In an exemplary embodiment, the limit 105*c* may be about two feet from the end 105*a* of the tubular 105, or perhaps about 5-10% of the total length of the tubular 105. However, the exact location of the limit 105*c* may vary within the scope of the present disclosure. For example, the distance separating the end 105*a* of the tubular 105 from the gripping limit 105*c* may be about equal to or at least slightly larger than the distance to which the tubular 105 is to be inserted into the running tool 110, as shown in subsequent figures and described below.

Figure 1B:
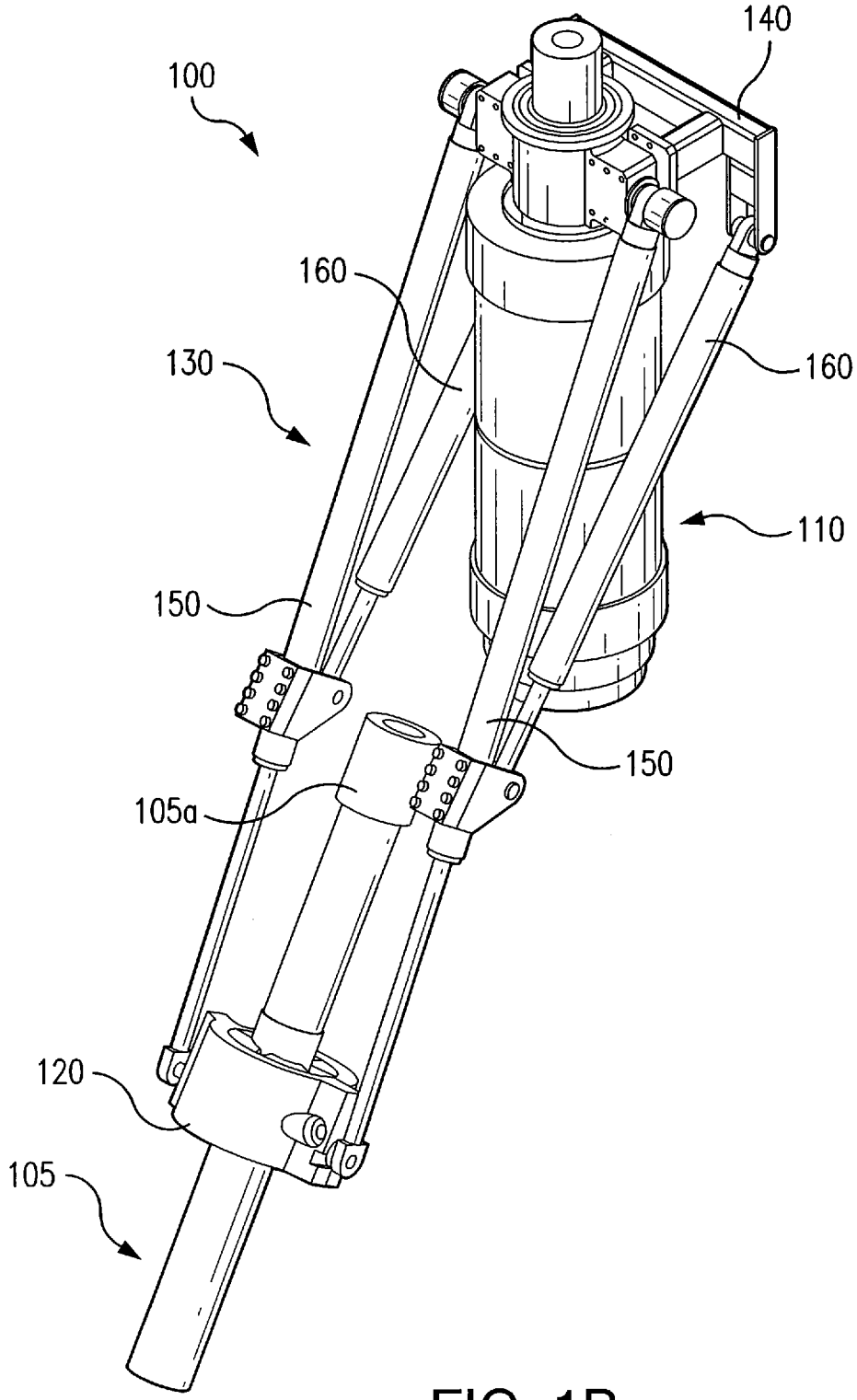
FIGS. 1B-G are perspective views of the apparatus shown in FIG. 1A in subsequent stages of operation.
Figure 1C:
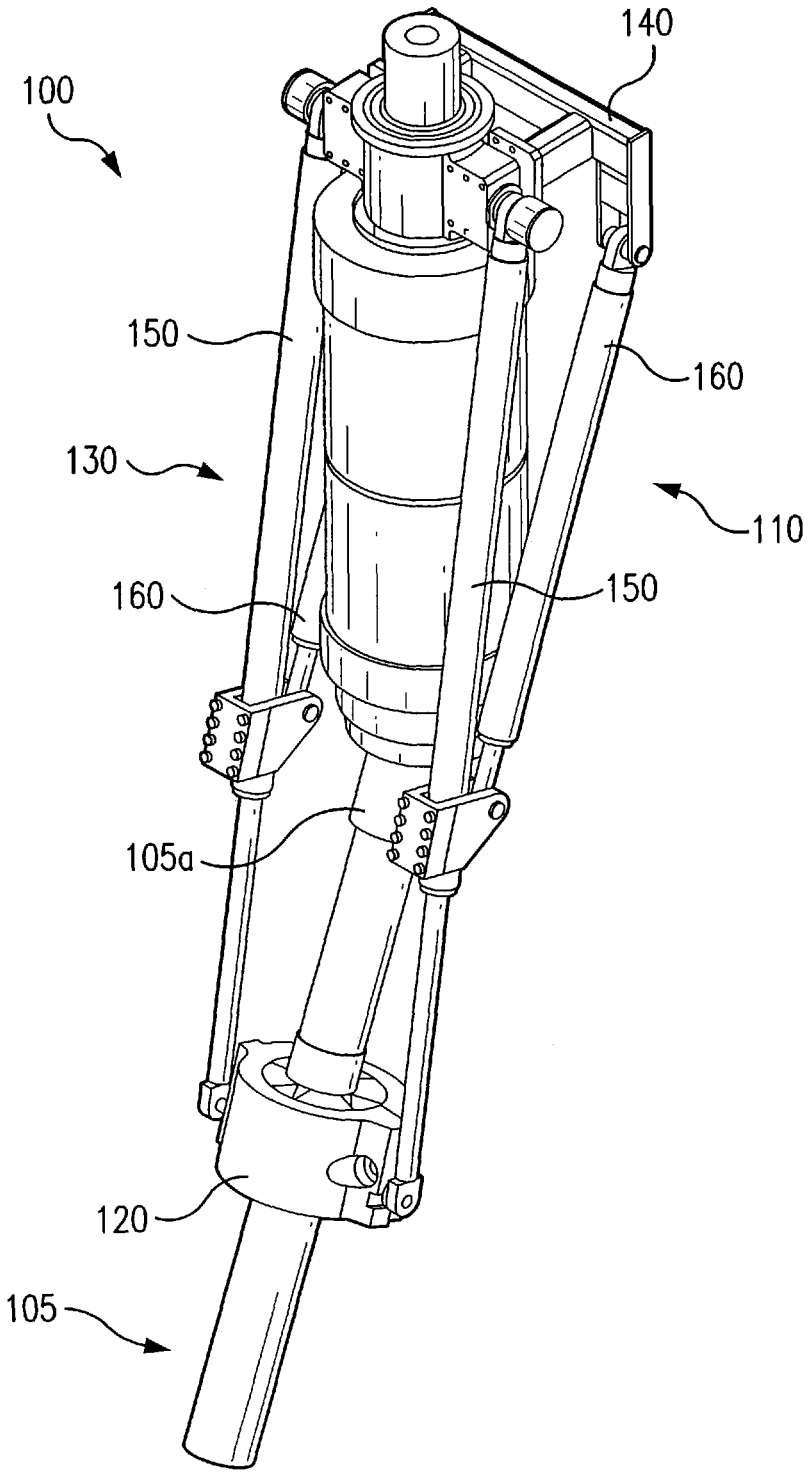
Figure 1D:
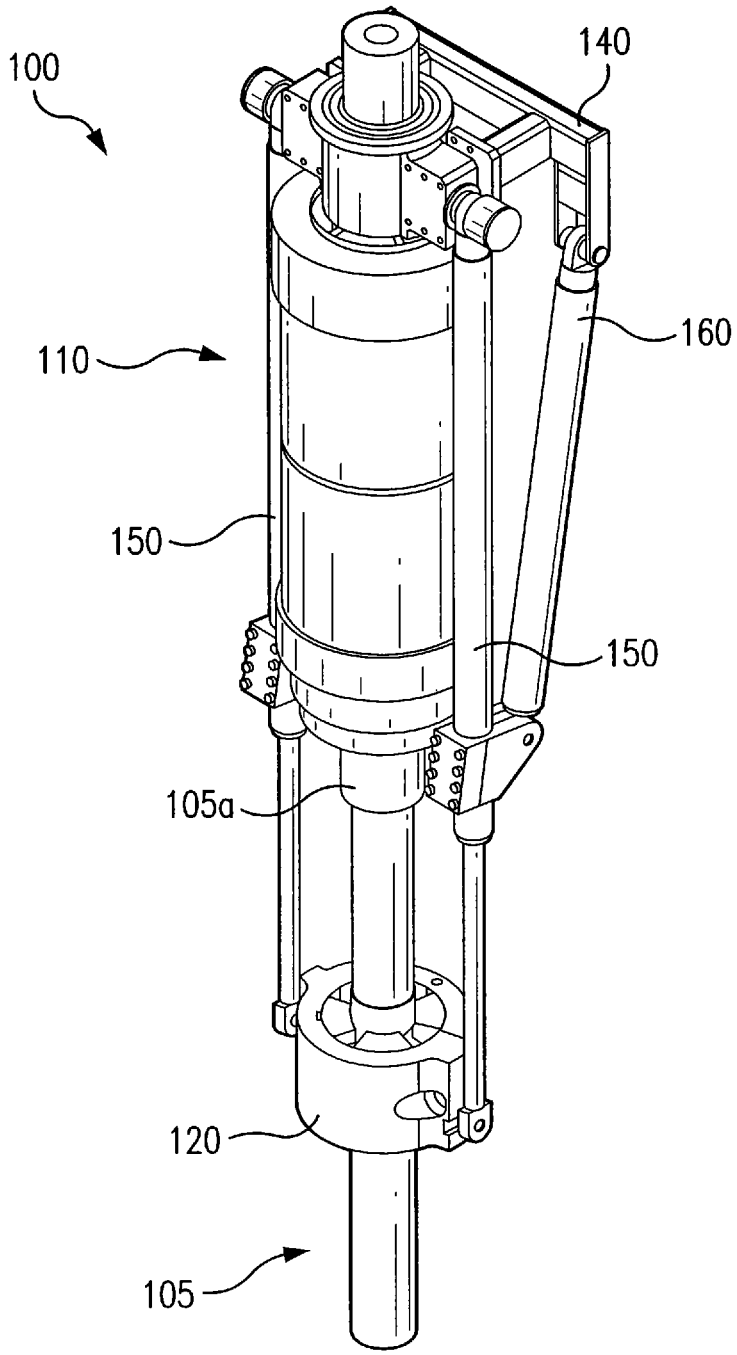

The actuators 150, 160 may be operated to position the elevator 120 around the intermediate portion 105*b* of the tubular 105, as shown in FIG. 1A. The elevator 120 may subsequently be operated to grip or otherwise frictionally engage the tubular 105. Then, as shown in FIG. 1B, the actuators 160 may be operated to rotate the elevator 120 and tubular 105 towards the centerline of the tubular string and/or running tool 110, such as by retracting the actuators 160 and thereby causing the actuators 150 to pivot about their attach points 150*a*. This can also be achieved by simply relying on an upward movement of the tubular through a retraction device (e.g., disposed in the collar 120). In another embodiment, the elevator 120 and gripped tubular may be permitted to fall towards the center under the running tool through operation of gravity pulling the tubular to the lowest point in the arc of the elevator's range of movement. As this movement continues, the end 105*a* of the tubular 105 is positioned in or near the bottom opening of the running tool 110, as shown in FIG. 1C. In an exemplary embodiment, this action continues until the tubular member elevator 120 and tubular 105 are substantially coaxially aligned with the running tool 110, as shown in FIG. 1D.

Figure 1E:
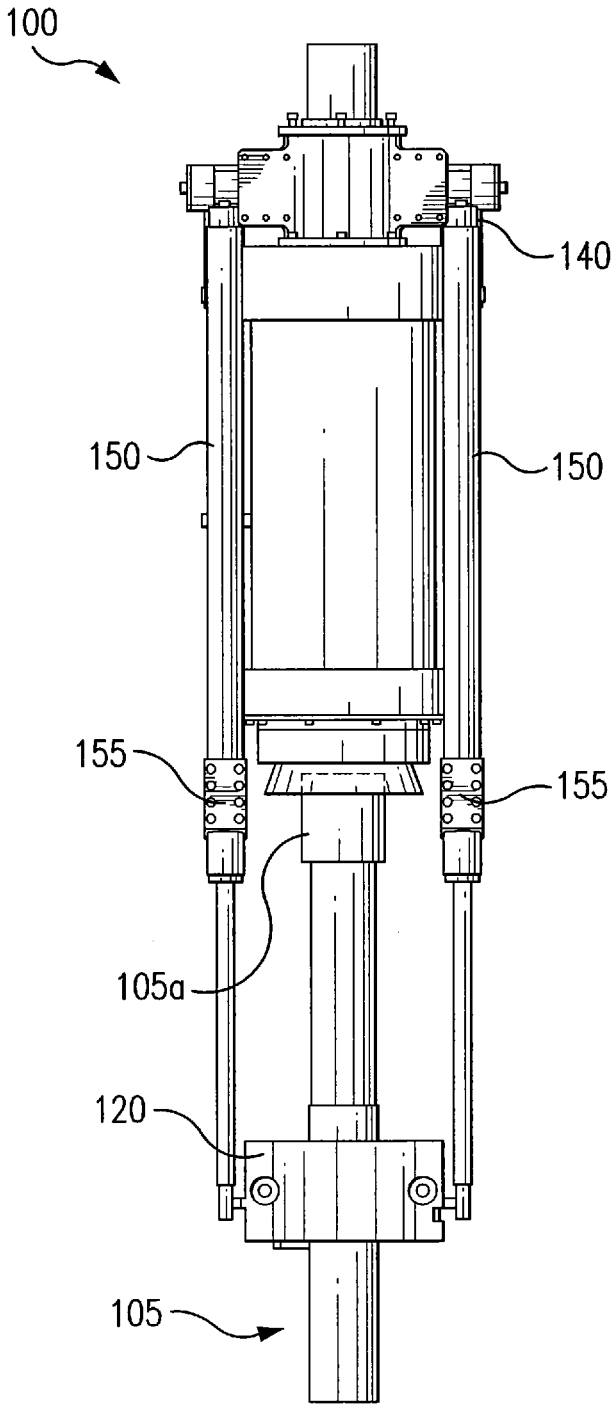
Figure 1F:
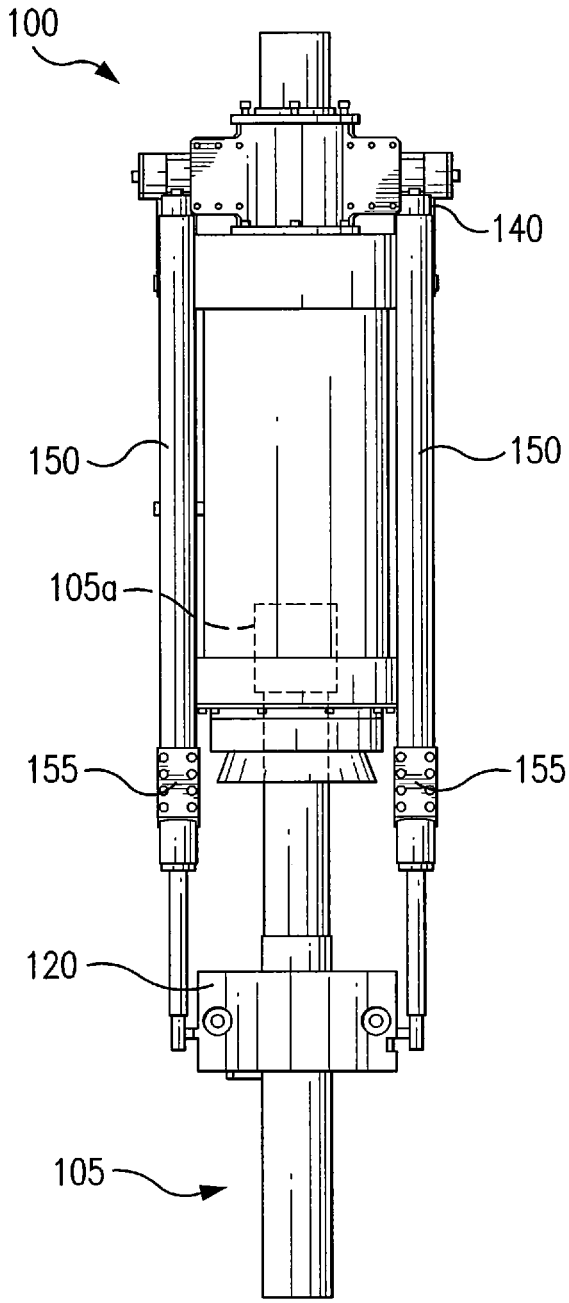
Figure 1G:
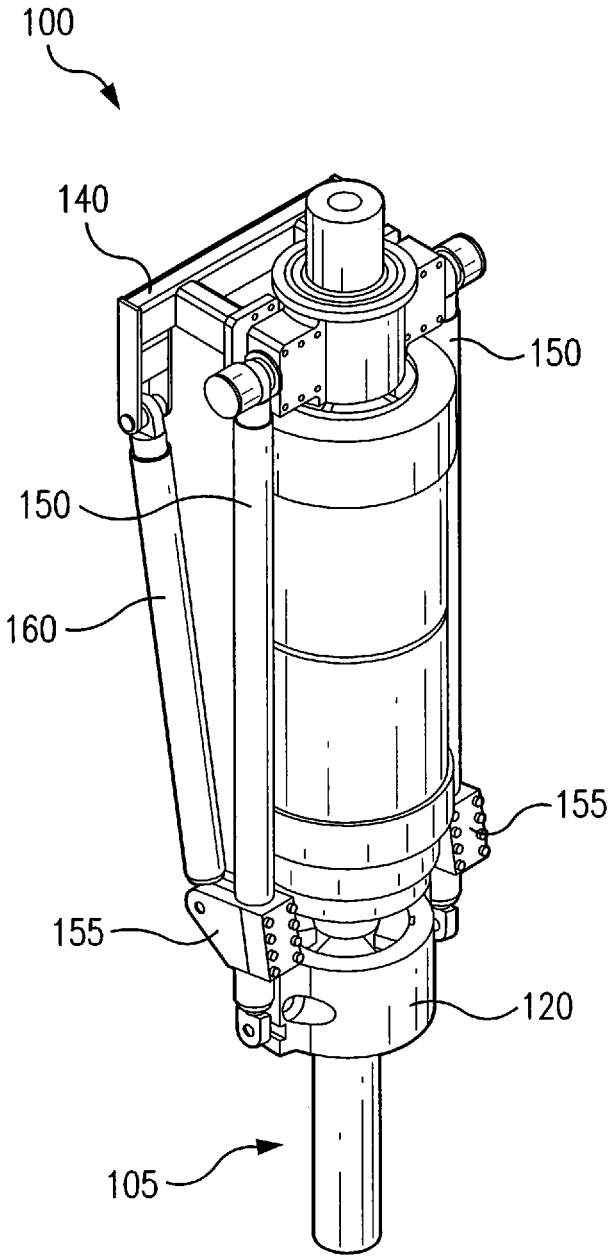

During subsequent steps of this procedure, the actuators 150 may be operated to insert the end 105*a* of the tubular 105 into the running tool 110, as shown in FIGS. 1E, 1F, and 1G. For example, the actuators 150 may be retracted to pull the end 105*a* of the tubular 105 into the running tool 110. As shown in FIG. 1G, the actuators 150 and the actuator 160 may be fully retracted, such that a significant portion of the end 105*a* of the tubular 105 may be inserted into the running tool 110. The running tool 110 may be configured to subsequently engage the tubular 105, such that the tubular 105 is retained even after the tubular member elevator 120 subsequently disengages the tubular 105. Alternatively, the tubular member elevator 120 may act to directly connect the tubular 105 to the tubular running tool 110. In one embodiment, at least a portion of a surface of a tubular is engaged by a tubular member elevator 120. The tubular member elevator 120 may interact with an inner, an outer or both an inner and an outer region of a tubular, as may the gripping elements (not shown) of the running tool 110. In a preferred embodiment, the elevator 120 and the running tool 110 each contact an outside surface of the tubular or the elevator 120 contacts an outside surface while the running tool 110 contacts at least an inside surface of the tubular. The tubular member elevator 120 can interact with the tubular along any surface of the tubular, whether near or distant from the end of the tubular. The tubular member elevator 120 can then act to position the tubular to interact with and be retained by the running tool 110. The running tool 110 may then engage at least one different surface of the tubular with a portion of the running tool 110 so that the tubular is retained solely as a result of the downward force created by the weight of the tubular interacting with the portion of the running tool 110, i.e., even if the elevator 120 fails the RT 110 will grip the tubular.

Once the end 105*a* of the tubular 105 is sufficiently or preferably fully inserted into and engaged and gripped by the running tool 110, a portion of the running tool 110 may form a fluidic seal with the end 105*a* of the tubular 105. For example, one or more flanges and/or other sealing components inside the running tool 110 may fit into and/or around the end 105*a* of the tubular 105 to form the fluidic seal. Such sealing components may at least partially comprise a rubber or other pliable material, or any combination thereof. The sealing components may additionally or alternatively comprise metallic or other non-pliable material. In an exemplary embodiment, the sealing components may comprise a threaded connection, such as a conventional box-pin connection.

The process sequentially depicted in FIGS. 1A-G may be employed to remove a drill string joint or other tubular member (e.g., tubular 105) from a pipe rack, other storage structure, handling tool, and/or other structure or tubular supply, and subsequently install the joint into a drill string or other tubular string. The process sequentially depicted in FIGS. 1A-G, or portions thereof, may also be reversed to remove a tubular from the string and, for example, set the removed tubulars down onto a pipe rack and/or other structure. For example, the process may further include disengaging the tubular member elevator after engaging and preferably gripping the tubular with the running tool and/or lowering the tubular gripped by the running tool onto a load-bearing surface. These steps may occur manually or automatedly through a control device that confirms gripping of the tubular is occurring before releasing the tubular member elevator 120.

Alternatively, the process of at least partially disengaging a tubular may include operating the running tool to interact with the tubular, then applying a rotational force to a tubular by any means such as, for example, a top drive. At least one surface of the tubular would be engaged with a portion of the running tool. Further, the tubular member elevator may then interact with the tubular such as, in a reverse manner as when engaging a tubular, and the running tool would then be lowered to further eliminate contact between the tubular with the tubular string. The tubular would then be raised to disengage at least one surface portion of the running tool. In some instances, the lowering of the running tool and the raising of the tubular can occur at the same time. These steps may occur manually or by automation.

In other instances, a tubular may be at least partially disengaged from a tubular string by operating the running tool to interact with the tubular, then applying a sufficient rotational force to the tubular by any means such as, for example, a top drive. Preferably, this rotational force is applied at least, and more preferably only, through the gripping elements of the running tool. Further, the tubular member elevator may then interact with the tubular such as in a reverse manner as when supplying a tubular to the running tool during a make-up operation described herein. Once the tubular member elevator retains the tubular being broken out, the gripping apparatus of the running tool is released. This can be achieved, e.g., by moving a bowl or segments thereof of the running tool at least partially in a direction having an axial component along the tubular being gripped to disengage the at least one surface portion of the tubular gripped by a portion of the running tool. The tubular could then be removed from the tubular handling apparatus. Other operations for releasing tubulars from the gripping apparatus are described herein.

Figure 2:
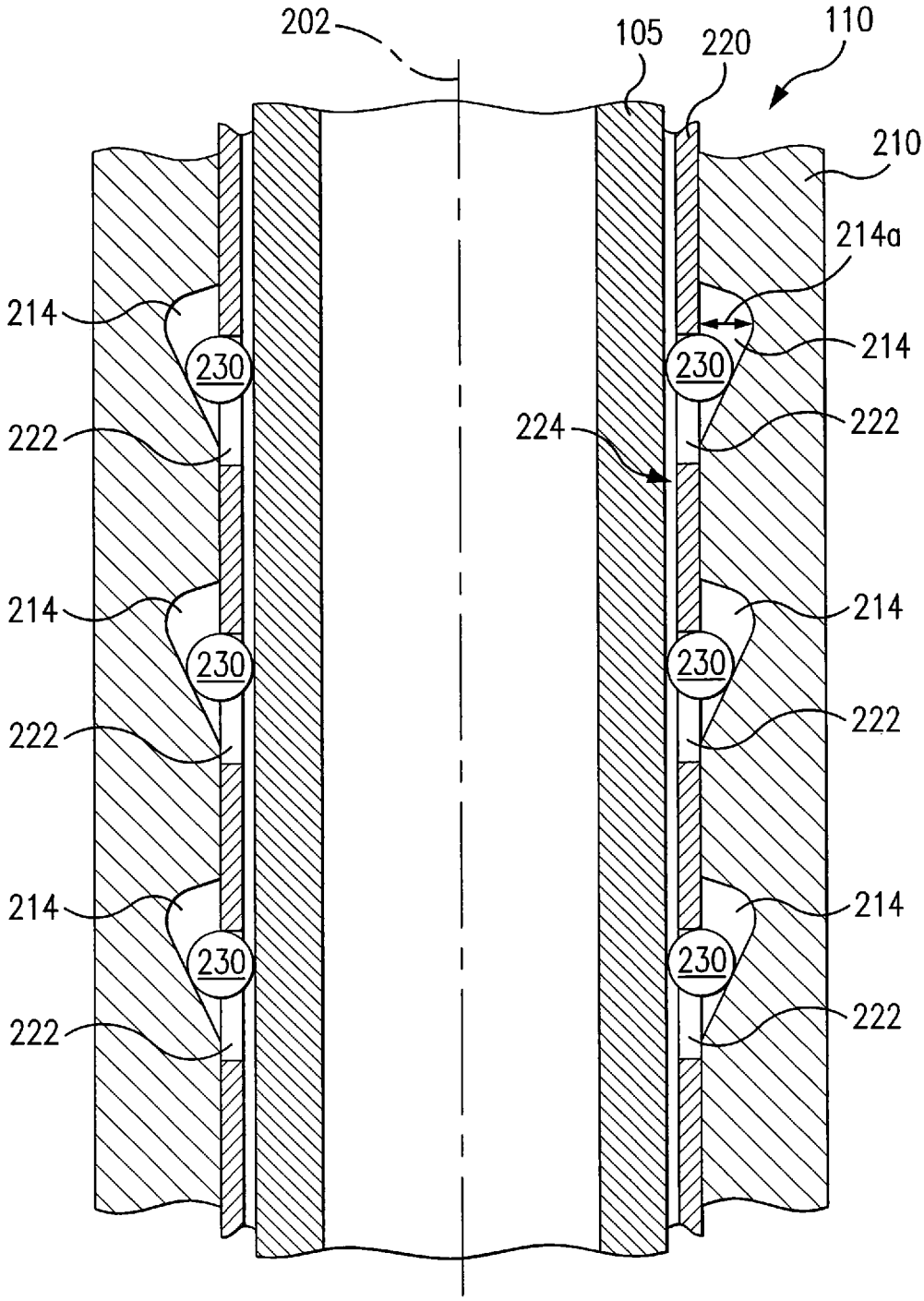
FIG. 2 is a sectional view of a portion of the apparatus shown in FIGS. 1A-G.

During such processes, the running tool 110 may be operated to engage and grip the tubular s being installed into or removed from the tubular string. Referring to FIG. 2, illustrated is a sectional view of at least a portion of an exemplary embodiment of the running tool 110 according to one or more aspects of the present disclosure. The running tool 110 includes a recessed member 210, a slotted or otherwise perforated member 220, and a plurality of griping elements, i.e., sliding or rolling members 230, or a combination thereof.

The tubular 105 may not be dimensionally uniform or otherwise ideal. That is, the tubular 105 may not exhibit ideal roundness or circularity, such that all of the points on an outer surface of the tubular at a certain axial position may not form a perfect circle. Alternatively, or additionally, the tubular 105 may not exhibit ideal cylindricity, such that all of the points of the outer surface may not be equidistant from a longitudinal axis 202 of the running tool 110, and/or the tubular 105 may not exhibit ideal concentricity, such that the axes of all cross sectional elements of the outer surface may not be common to the longitudinal axis 202.

A portion of the running tool is thus configured to frictionally engage at least one surface of a tubular sufficient to grip the tubular and preferably additionally to apply a torque to the tubular. The running tool may be configured to frictionally engage an inner surface of a tubular, an outer surface, or both as discussed herein. The recessed member 210 may be or comprise a substantially cylindrical or otherwise shaped member having a plurality of recesses 214 formed therein. The recesses 214 may each extend between a deep and a shallow end. The perforated member 220, typically slotted and referred to herein as a slotted member (but not limited to such a configuration), may be or comprise a substantially cylindrical or otherwise shaped annulus member having a plurality of slots (or otherwise-shaped apertures) 222 formed therein. The slots may be elongated and extend at least partially in a direction substantially parallel to a longitudinal axis of a tubular to be handled. The plurality of elongated slots may be fixed relative to the plurality of recesses. Additionally, the slots may overlap at least partially or entirely with the recesses. Preferably, each slot 222 is configured to cooperate with one of the recesses 214 of the recessed member 210 to retain one of the gripping members 230. Moreover, each recess 214 and slot 222 are configured such that, when a gripping element 230 is moved further away from the maximum depth 214*a* of the recess 214, the gripping element 230 protrudes further through the slot 222 and beyond the perimeter 224 of the slotted member 220, and when the gripping element 230 is moved towards the maximum depth 214*a* of the recess 214, the rolling or sliding member 230 also moves towards a retracted position at least partially within the inner perimeter 224 of the slotted member 220.

In one preferred embodiment, the sliding and rolling members, or combination thereof (such members also referred to herein as "gripping elements") are retained at least substantially between the slots and the recesses. When in the shallow end of a recess, the gripping elements are sized and dimensioned so as to be retained by the corresponding slot while extending partially therethrough to contact a tubular placed adjacent thereto. The gripping element in the deep end of the recess will typically extend less than about 20% of its radius, preferably less than about 10% of its radius, more preferably less than about 5% of its radius, and in one embodiment will not extend at all through the corresponding opening of the slotted member. It should be understood that the plurality of "gripping elements" referred to throughout the application may be sliding members, rolling members, or a combination thereof in any given instance.

The plurality of gripping members 230 can be adapted to move downwardly, e.g., partially or solely through the force of gravity applied to a tubular that is in contact therewith, so that the running tool can grip the tubular. As the gripping elements are moved toward the shallow end of their corresponding recess, this can effectively pinch a number of the gripping elements between the corresponding recesses and the tubular itself to cause frictional gripping. Preferably, gripping occurs when the tubular moves downwards relative to the running tool, and more particularly, relative to the gripping apparatus therein. A powered engagement is also feasible, as the gripping elements can be pushed into place by, e.g., powered springs or actuation devices associated with each gripping element, or a sleeve that is operatively associated with each such gripping element (not shown). This gripping is a reversible process so that disengagement of the tubular can take place in the reverse manner by moving the tubular or tubular string upwards, or otherwise towards the running tool. Alternatively, the downward motion of the rolling or sliding members 230 can result in the disengagement of the tubular, depending on the orientation of the tubular running tool and the gripping assembly and its gripping elements therein. The plurality of gripping elements 230 can each retract at least partially into at least one slot of the slotted member when the tubular handling apparatus is gripping the tubular. In some instances, each rolling or sliding member 230 can retract into one, two, three or more slotted members. The plurality of gripping members 230 may each retract partially, almost entirely, or entirely into at least one slot of the slotted member and at least one recess of the recessed member when the tubular handling apparatus is not present or is engaged but not gripping a tubular. Preferably, the retraction is only partial so that the gripping elements are in contact when the tubular is engaged, as this can facilitate gripping. Thus, when partially retracted, the gripping elements still extend partially from the recess through the slotted member to engage, or contact, a tubular having an end disposed therein. The tubular running tool can be operatively associated with a handling mechanism or feeder adapted to place or feed a tubular into, or remove a tubular from, the tool. This handling mechanism can be part of an operatively associated tubular member elevator or an entirely separate component.

Each slot 222 may have an oval or otherwise elongated profile, such that each slot 222 is greater in length than in width. The length of the slot 222 is at least substantially, and preferably entirely, in the direction of the longitudinal axis 202 of the running tool 110. The walls of each slot 222 may be tapered radially inward towards the deep end of the corresponding recess, and/or the slope of the recess between deep and shallow ends can be made steeper, to facilitate faster gripping and retraction.

Each recess 214 may have a width (into the page in FIG. 2) that is at least about equal to or slightly larger than the width, or diameter, of each gripping member 230. Each recess 214 may also have a length that is greater than a minimum length of the slot 222. The width or diameter of the gripping element 230 is at least larger than the width of the internal profile of the slot 222.

Because each slot 222 is elongated along the direction of the taper of the recesses 214, each gripping element 230 may protrude from the slotted member 220 an independent amount based on the proximate dimensional characteristics of the tubular 105 being contacted or gripped. For example, if the outer diameter of the tubular 105 is smaller near the end 105*a* of the tubular 105, the rolling member 230 located nearest the end 105*a* of the tubular 105 protrudes from the slotted member 220 a greater distance relative to the distance which the rolling member 230 nearest the central portion of the tubular 105 protrudes from the slotted member 220.

Each of the rolling or sliding elements 230 may be or comprise a substantially spherical member, such as a steel ball bearing. Other materials and shapes are also within the scope of the present disclosure. For example, each of the gripping elements 230 may alternatively be a cylindrical or tapered pin configured to roll or slide up and down the ramps defined by the recesses 214. The gripping elements need not be the same shape or the same material, and can be selected independently, but in one preferred embodiment they are the same shape and material at a given axial position, and more preferably at all axial positions. For example, the members may be a half-ball or at least substantially or entirely rounded on one side or portion, and a different shape on another portion (e.g., flat, or sufficiently U- or V-shaped to fit a corresponding recess of that shape). In another embodiment, a layer may be disposed on a portion of the sliding or rolling member that contacts and grips the tubular, or on a portion that contacts the recess, to provide for modified gripping. For example, such a layer might include a material that increases friction or gripping power with a much harder material forming the core of such a sliding or rolling member. Or the layer may face the recess and be adapted to minimize friction to facilitate additional gripping as the gripping elements slide towards the shallow end of the recess, while having a higher friction material facing the tubular to maintain frictional gripping. The gripping elements can be spring-loaded to urge the gripping elements outwards or inwards, as needed, towards the tubular, or could be powered in another embodiment to urge the gripping elements into engaging and/or gripping position as noted herein.

Figure 3A:
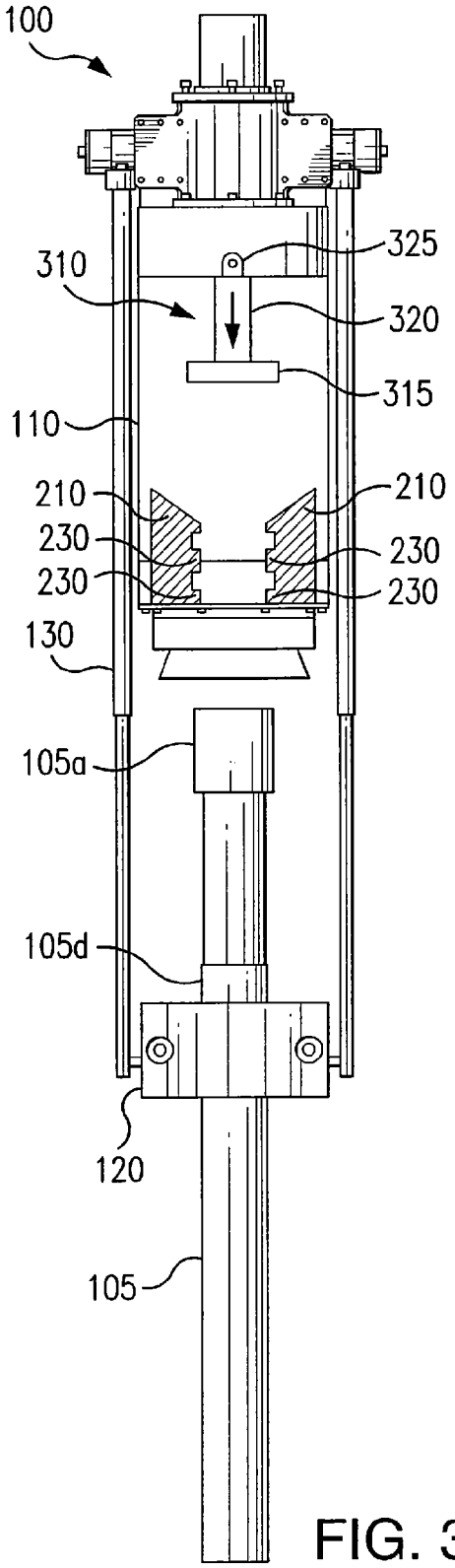
FIGS. 3A-D are partial sectional views of the apparatus shown in FIGS. 1A-G in a series of operational stages.
Figure 8:
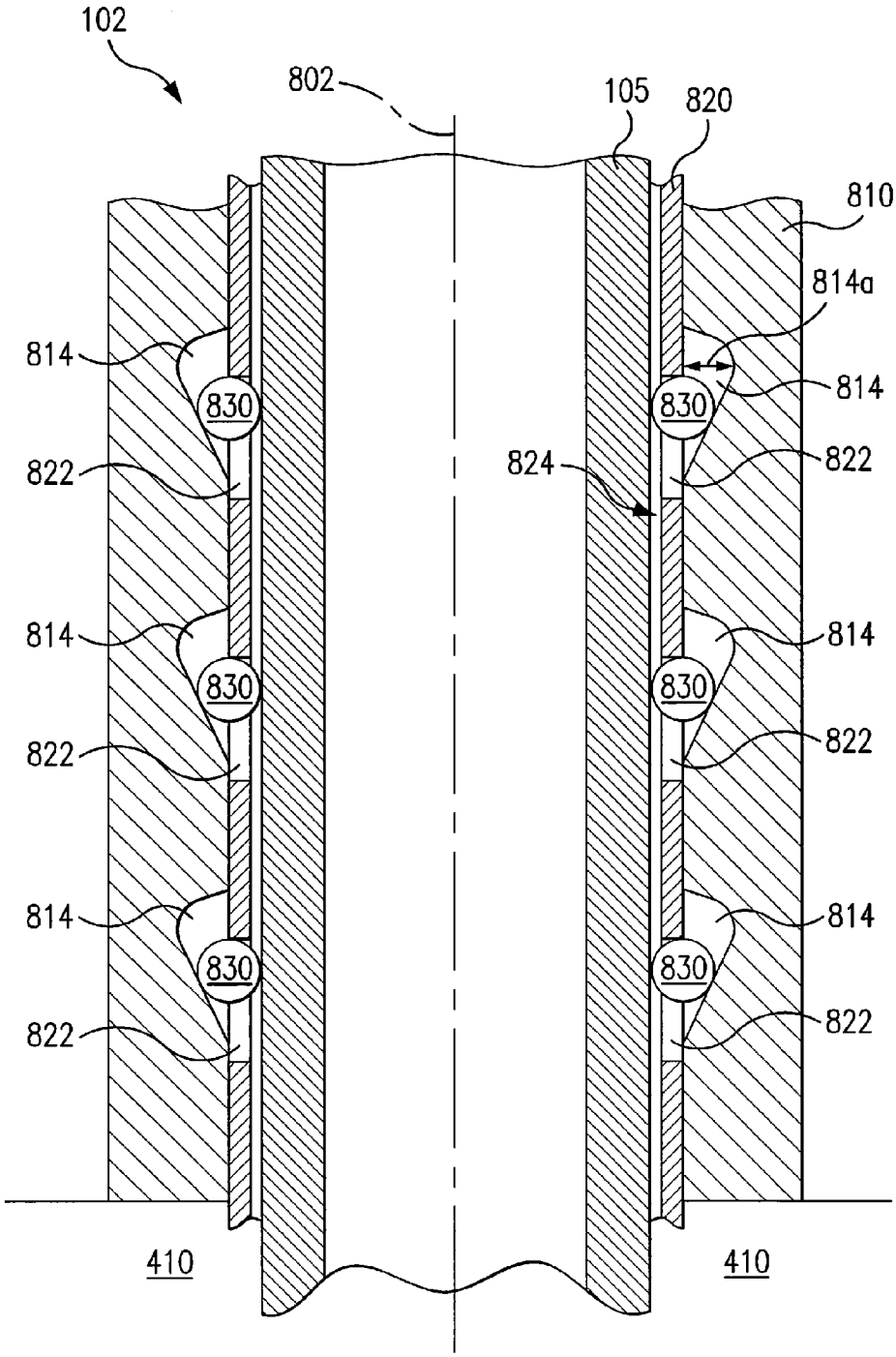
FIG. 8 is a sectional view of a portion of a floor slip gripping assembly according to one or more aspects of the present disclosure.

Referring to FIG. 3A, illustrated is a partial sectional view of the apparatus 100 shown in FIGS. 1A-G, including the embodiment of the running tool 110 shown in FIG. 2. In FIG. 3A, the apparatus 100 is depicted as including the tubular running tool 110, the tubular member elevator 120, and the link tilt assembly 130 of FIGS. 1A-G. FIG. 3A further illustrates the recessed member 210 and gripping elements 230 of the embodiment of the running tool 110 that is shown in FIG. 2. The embodiment of the apparatus 100 that is shown in FIG. 3A, however, may comprise additional components which may not be illustrated for the sake of clarity but may be understood to also exist. For example, floor slips 102 adapted to hold a tubular may be present, and may operate in connection with the tubular running tool. The floor slips 102 may be present adjacent to, abutting, or on top of, the rig floor 410. In another embodiment (not shown), the floor slips 102 may be partially or entirely below the top surface of the rig floor 410 and within the rig floor structure, particularly where the rig itself is portable. The floor slips 102 may be reversibly coupled to the rig floor, or may be permanently fixed as needed. As shown in FIG. 8, the floor slips 102 may have substantially the same orientation and gripping assembly as the running tool noted above. For example, the floor slips 102 may include a slotted floor slip component 820 having a plurality of elongated slots 822. Each slot 822 could be adapted to extend at least partially in a direction substantially parallel to a longitudinal axis of a tubular to be handled 802. In addition, the floor slips 102 may include a recessed floor slip component operably associated with the slotted floor slip component 820 and having a plurality of floor slip recesses 814 in a surface thereof that extend between a deep end 814*a* and a shallow end. There may also be present a plurality of rolling floor slip gripping components 830 operatively associated with the plurality of elongated floor slip slots 822 and the plurality of floor slip recesses 814. Each of the plurality of rolling floor slip gripping components 830 may retract within at least a portion of the slotted floor slip component 820 when located in the deep end 814*a* of a corresponding floor slip recess. In addition, each of the plurality of rolling floor slip components may be configured to retract at least partially into at least one slot of the slotted floor slip component when the floor slip is in a gripping position to grip a tubular or tubular string. The floor slips 102 may be adapted to provide load-bearing capacity for a tubular or tubular string that is suspended from the floor slips 102. The floor slips 102 may be able to be reversibly coupled to and rotate a tubular or tubular string when the floor slips 102 are gripping the tubular or tubular string. Alternatively, or additionally, the floor slips 102 may be reversibly coupled to a rotary table. The floor slips 102 may reversibly grip a tubular or tubular string and so may be in either a gripped or released position. The floor slips 102 may be operated either hydraulically, pneumatically or manually. In order to maintain the gripped position, the floor slip may contain a latching mechanism to lock the floor slip around the tubular or tubular string. The latching mechanism may include, e.g., a powered or unpowered mechanism to cause the locking, or gripping, and optionally but preferably also includes a pre-load member to provide sufficient axial force to cause the floor slip components to grip and preferably also be able to rotate the tubular or tubular string.

The floor slips 102, as with the running tool and the tubular member elevator, may each independently further include a centering mechanism to facilitate centering of the tubular or tubular string adjacent the wellbore center. This centering mechanism may be one or more ramp structures that correspond to the bowl segments and direct the bowl segments radially inwardly as they are moved into an engagement position (when the outer surface of a tubular is contacted). As the bowl segments move into engagement position, the ramps are angled to direct the bowl segments inwardly toward the tubular so that a complete "bowl" can be formed from the multiple bowl segments so that the gripping elements contact and then engage a tubular. Each ramp at least substantially surrounds the gripping assembly bowl(s) when they are in engagement position, and each ramp is preferably a conical section, but may be any shape to correspond to a surface of the bowl or bowl section that is opposite the side with the recessed slots that is operatively associated with the gripping elements. Each ramp is typically concentrically arranged around a grouping of bowl segments that form a bowl once the bowl segments are moved into engagement position.

The floor slips 102 can further include an interlock system that is adapted to prevent the release of one or more tubulars being gripped by the floor slip until the one or more tubulars is confirmed as being gripped by an operatively associated running tool or tubular member elevator. Confirmation can occur automatically, such as by a computer program, or visually by an oil rig worker, or a combination thereof. Methods of engaging a tubular or tubular string with the floor slips can include engaging a surface portion of a tubular with the floor slips, and operating the floor slip into a gripping position to position the tubular within the wellbore and into alignment with a tubular to be added that is engaged by a running tool, tubular member elevator, or both. Methods of disengaging a tubular or tubular string from the floor slips can include operating or moving the floor slips from a gripping position to a released position and disengaging contact between at least one surface of the tubular or tubular string and the floor slips.

Moreover, FIG. 3A also illustrates that the running tool 110 may comprise a pre-load mechanism 310. In one embodiment the pre-load mechanism reversibly exerts pressure on the end of a tubular when engaged in the tubular running tool 110. The pre-load mechanism 310 can be configured to apply an axial force to the end 105*a* of the tubular 105 once the tubular 105 is inserted a sufficient distance into the running tool 110. For example, in the exemplary embodiment shown, the pre-load mechanism 310 includes a tubular interface 315, an actuator 320, and a running tool interface 325. The tubular interface 315 may be or comprise a plate, clamp, claw, piston, dies, and/or other suitable structure(s) configured to transfer the axial load supplied by the actuator 320 to the tubular 105, preferably at an end 105*a* thereof. The actuator 320 may be or comprise a linearly actuated cylinder which is operable hydraulically, electrically, mechanically, pneumatically, or via a combination thereof. The running tool interface 325 may be or comprise a threaded fastener, a pin, and/or other means for coupling the actuator 320 to the internal structure of the running tool 110. The pre-load mechanism can be positioned to apply this force (or pressure) anywhere on the tubular, such as at the top, or even by grasping an inside diameter or an outside diameter to apply this additional pre-load force in association with make-up or break-out. Preferably, the pre-load is applied by an actuator at an end of the tubular, typically the top end of the tubular that is inside the running tool 110.

In the configuration illustrated in FIG. 3A, the tubular 105 has been engaged by the elevator 120 and subsequently oriented in substantial axial alignment underneath the running tool 110. The tubular 105 may have a marking 105*d* which indicates the minimum offset required between the end 105*a* and the longitudinal position at which the tubular 105 is engaged by the elevator 120.

Figure 3B:
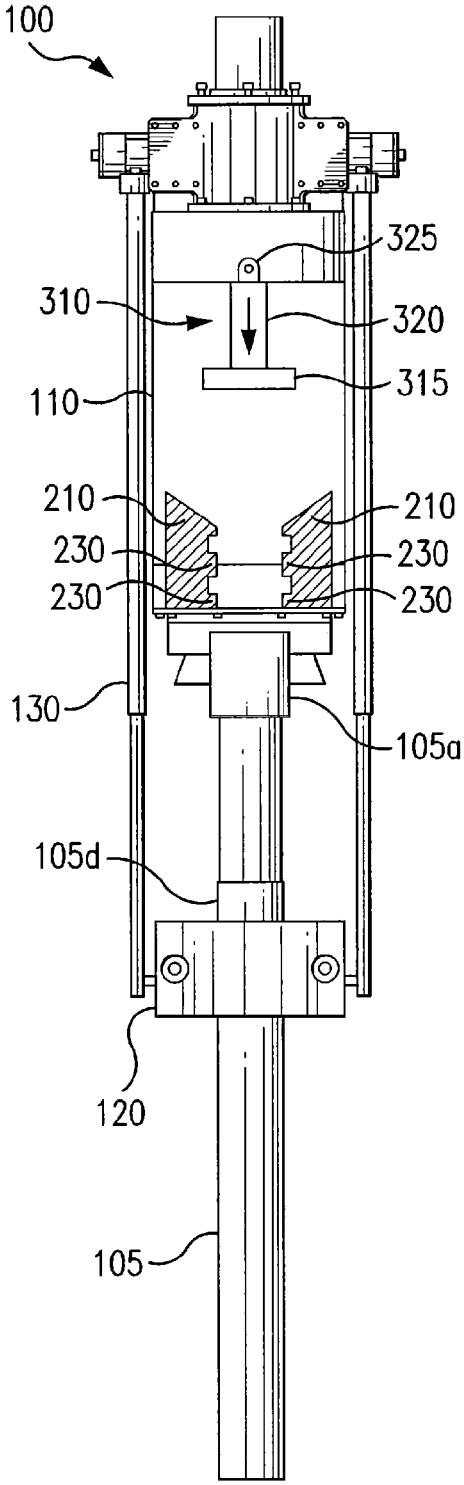

After the axial alignment depicted in FIG. 3A is achieved, the link tilt assembly 130 may be actuated to begin inserting the tubular 105 into the running tool 110, as shown in FIG. 3B. As the tubular 105 enters the running tool 110, the gripping elements 230 slide and/or roll against the outer perimeter of the tubular 105, thus applying very little radially-inward force to the tubular 105. (Alternatively, the insert members 210 may be retracted to the extent that they and the gripping elements associated therewith do not touch the tubular 105.) This continues until the end 105*a* of the tubular 105 nears or abuts the tubular interface 315 of the pre-load mechanism 310.

Figure 3C:
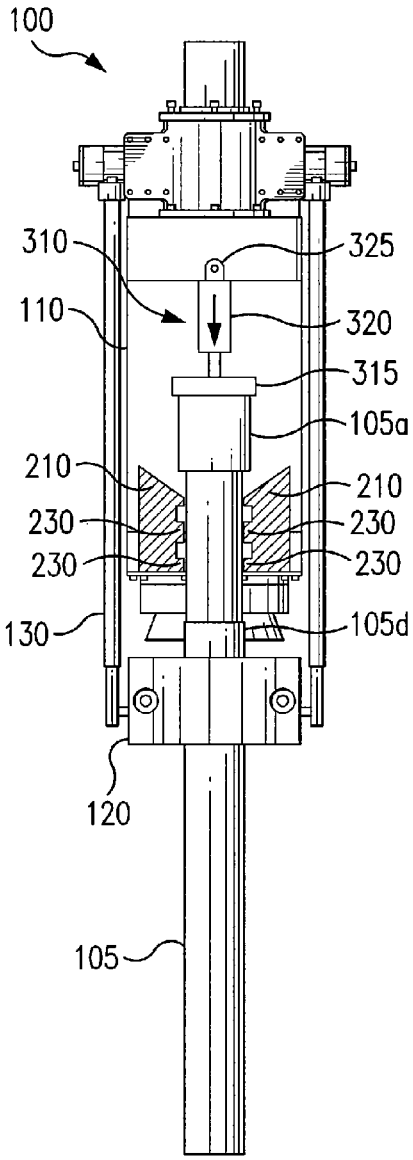

Subsequently, as shown in FIG. 3C, the members 210 move radially inward such that the gripping elements (or rolling or sliding members) 230 contact the surface of the tubular 105, and the actuator 320 of the pre-load mechanism 310 depicted in this Fig. is actuated to apply an axially-downward force to the end 105*a* of the tubular 105. This downward force actively engages the gripping elements 230 with the outer or inner perimeter of the tubular 105, or both. Accordingly, the tubular 105 is positively engaged by the running tool 110, and the tool then grips the tubular not only by the weight of the tubular 105 but also any optional axial force applied by the pre-load mechanism 310.

Figure 3D:
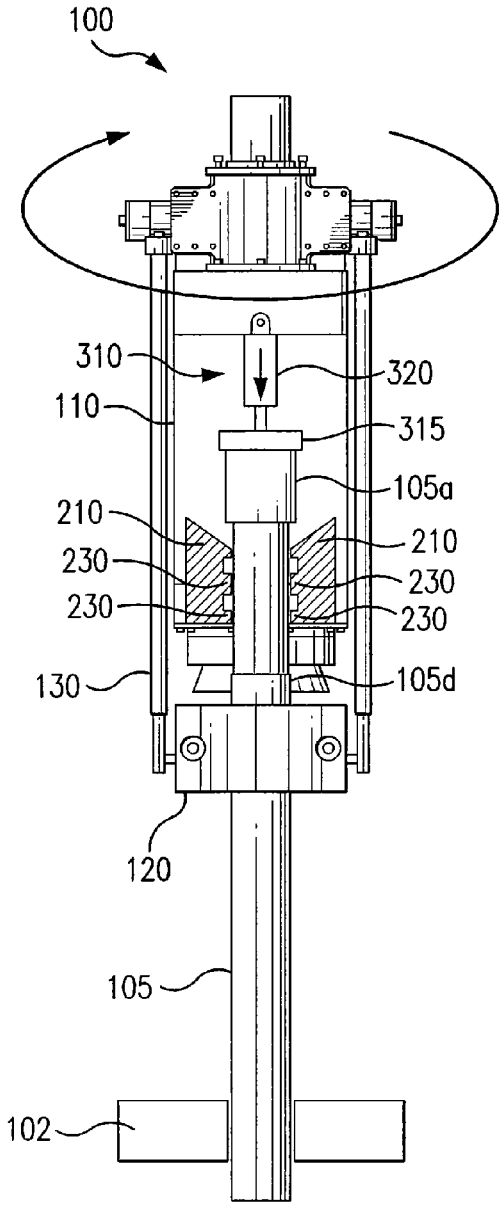

Consequently, as depicted in FIG. 3D, the running tool 110 may be rotated, which thereby rotates the tubular 105. That is, the torque applied to the running tool 110 (e.g., by a top drive coupled directly or indirectly to the running tool 110) is transferred to the tubular preferably via the gripping elements 230 that grip the tubular, among other components of the running tool 110. During such rotation, the elevator 120 may be, and is preferably, disengaged from the tubular 105, such that the entire weight of the tubular 105 is supported by the running tool 110 (if not also the weight of a drill string attached to the tubular 105 as the tubular is threaded to the tubular string, or when the break-out of a tubular from the tubular string is initiated).

To remove the engaged and gripped tubular 105 from the running tool 110, the assembly of the tool 100 and the tubular 105 is disengaged from the floor slips 102. The assembly of the tool 100 and the tubular 105 is then preferably lowered to the desired position, the floor slips 102 are re-engaged to grip the tubular in a position above (in make-up) or below (in break-out) the previous floor slip gripping position on the tubular or tubular string. The actuator 320 of the pre-load mechanism 310 is then preferably retracted to remove the axial force from the end 105*a* of the tubular 105. The pre-load can be removed at any point in the process after being applied, but preferably is removed after the rotation has concluded. It can be removed either before or after the floor slips have again gripped the tubular nearer the top (in make-up operation) or below (in break-out operation) so that the running tool 110 can be released and a further tubular or tubular string inserted. The gripping elements 230 are then typically disengaged. The inserts 210 can be retracted to allow the upward movement of the tool 100, clearing it from the enlarged element 105*a*. The slotted member of the running tool (shown in FIG. 2 but not in FIGS. 3A-D) may also be translated by one or more actuators coupled thereto in one embodiment, such as upwardly, or to radially contract or expand, such that the gripping elements 230 may become free to release from gripping the tubular 105 (although they may still be in contact therewith) or to release from gripping and disengage from contact with the tubular or tubular string (not shown).

In varying embodiments not necessarily depicted, the slotted member is typically adapted to be fixed, to slide or rotate, or to radially expand or contract, relative to the recessed member. Typically, the slotted and recessed members form a "cage" to retain the gripping elements therebetween. In an embodiment where the gripping occurs on an outer surface of a tubular, the slotted member is preferably fixed, or may be adapted to expand radially. In this embodiment, the entire gripping assembly of slotted and recessed members, along with the gripping elements, is moved to release the tubular from gripping. This movement preferably is axially at least substantially along, or entirely along, the length of the tubular or tubular string, and preferably upwards, to release the frictionally pinched gripping elements. Concurrently or immediately thereafter, the gripping assembly (also referred to as a "bowl", and including at least the recessed member, slotted member, and gripping elements) is moved at least radially away from the tubular or tubular string to permit the end 105*a* to clear the gripping assembly. The bowl segments may be moved into position for engagement and disengagement of a tubular by the use of ramps. Similar to those described above, the ramps at least substantially surround the bowls and are preferably cylindrical, but may be any shape. When gripping and then engaging an outer surface of a tubular with the bowl, the ramp structure typically moves in a downward direction to move the bowl sections inwardly to form the bowl. As it does so, the ramps move inward towards the bowl sections so that the bowl can contact and engage the tubular. The gripping assembly may be formed in multiple radially oriented parts, such as preferably two to five segments, and more preferably three to four segments, around the circumference of the tubular. More than one, e.g., two, three, four, or even five, gripping assemblies can be stacked axially through the running tool so that a tubular or tubular string may be engaged and then gripped by multiple gripping assemblies. Preferably, the gripping assembly is also moved axially upwards to facilitate release of the tubular or tubular string. This radial movement is typically outwards to release (when the gripping occurs on an outer surface of the tubular) and inwards to release (when the gripping occurs on an inner surface of the tubular). In an embodiment where the gripping occurs on an inner surface of the tubular, the slotted member is preferably adapted to slide, or to contract radially inwards, to facilitate release of the tubular from gripping. It should be understood that when the slotted member contracts or expands, a collapsible mandrel may be used, and when the slotted member is in sliding arrangement the actuator may be adapted to move the slotted member up (which is preferred), down, or both in symmetric or asymmetric fashion, to release the gripping of the tubular. It should also be understood that the gripping and any other embodiments herein can be on an outside surface, inside surface, or both, of the tubular to be made-up or broken-out.

Figure 4:
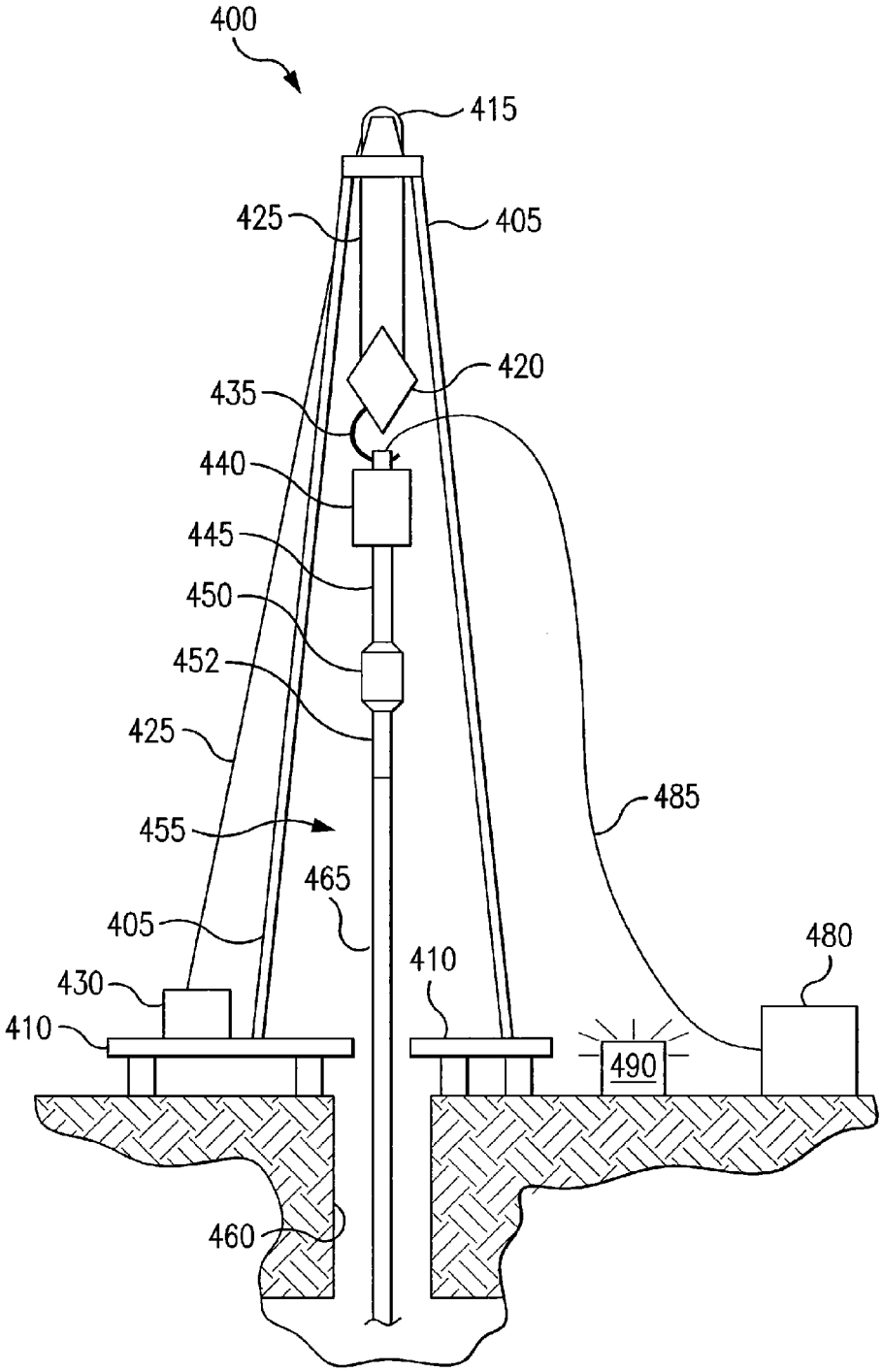
FIG. 4 is a schematic diagram of apparatus according to one or more aspects of the present disclosure.

Referring to FIG. 4, illustrated is a schematic view of apparatus 400 demonstrating one or more aspects of the present disclosure. The apparatus 400 demonstrates an exemplary environment in which the apparatus 100 shown in FIGS. 1A-G, 2, and 3A-D, and/or other apparatus within the scope of the present disclosure may be implemented.

The apparatus 400 is or includes a land-based drilling rig. One or more aspects of the present disclosure are, however, applicable or readily adaptable to any type of drilling rig, such as jack-up rigs, semisubmersibles, drill ships, coil tubing rigs, and casing or casing drilling rigs, among others.

Apparatus 400 includes a mast 405 supporting lifting gear above a rig floor 410. The lifting gear includes a crown block 415 and a traveling block 420. The crown block 415 is coupled at or near the top of the mast 405, and the traveling block 420 hangs from the crown block 415 by a drilling line 425. The drilling line 425 extends from the lifting gear to drawworks 430, which is configured to reel out and reel in the drilling line 425 to cause the traveling block 420 to be lowered and raised relative to the rig floor 410.

A hook 435 is attached to the bottom of the traveling block 420. A top drive 440 is suspended from the hook 435. A quill 445 extending from the top drive 440 is attached to a saver sub 450, which is attached to a tubular lifting device 452. The tubular lifting device 452 is substantially similar to the apparatus 100 shown in FIGS. 1A-G and 3A-D, among others within the scope of the present disclosure. As described above with reference to FIGS. 1A-G and 3A-D, the lifting device 452 may be coupled directly to the top drive 440 or quill 445, such that the saver sub 450 may be omitted.

The tubular lifting device 452 is engaged with a drill string 455 suspended within and/or above a wellbore 460. The drill string 455 may include one or more interconnected sections of drill pipe 465, among other components. One or more pumps 480 may deliver drilling fluid to the drill string 455 through a hose or other conduit 485, which may be connected to the top drive 440.

The apparatus 400 may further comprise a controller 490 configured to communicate wired or wireless transmissions with the drawworks 430, the top drive 440, and/or the pumps 480. Various sensors installed through the apparatus 400 may also be in wired or wireless communication with the controller 490. The controller 490 may further be in communication with the running tool 110, the elevator 120, the actuators 150, and the actuators 160 of the apparatus 100 shown in FIGS. 1A-G and 3A-D. For example, the controller 490 may be configured to substantially automate operation of the elevator 120, the actuators 150, and the actuators 160 during engagement of the elevator 120 and a tubular 105. The controller 490 may also be configured to substantially automate operation of the running tool 110, the elevator 120, the actuators 150, and the actuators 160 during engagement of the running tool 110 and a tubular 105.

Figure 5A:
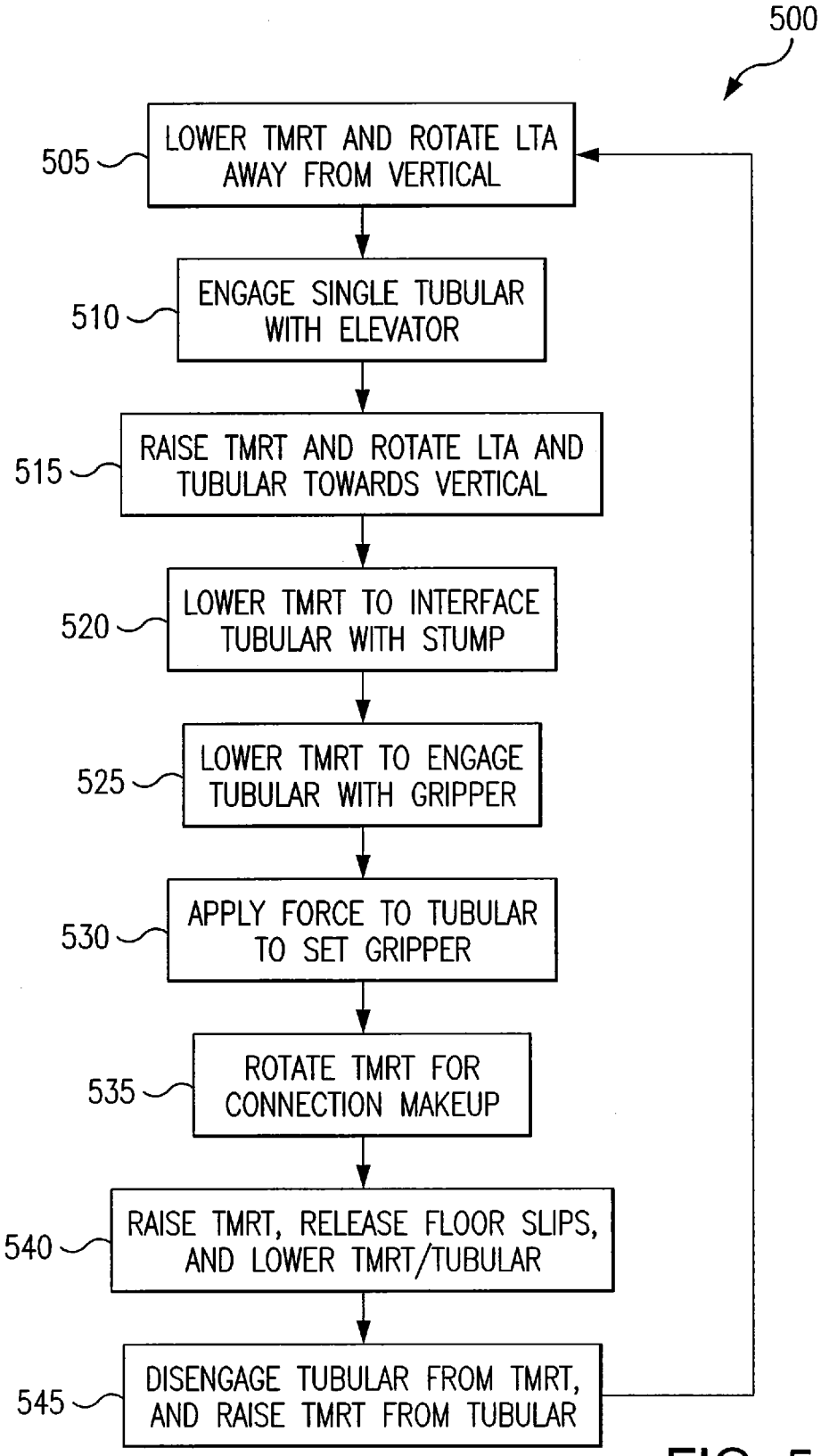
FIG. 5A is a flow-chart diagram of at least a portion of a method according to one or more aspects of the present disclosure.

Referring to FIG. 5A, illustrated is a flow-chart diagram of at least a portion of a method 500 according to one or more aspects of the present disclosure. The method 500 may be substantially similar to the method of operation depicted in FIGS. 1A-G and 3A-D, and/or may include alternative or optional steps relative to the method depicted in FIGS. 1A-G and 3A-D. The system 400 shown in FIG. 4 depicts an exemplary environment in which the method 500 may be implemented.

For example, the method 500 includes a step 505 during which the tubular running tool (TMRT) is lowered relative to the rig, and the link tilt assembly (LTA) is rotated away from its vertical position. Additional positioning of the TMRT and LTA may be performed such that the elevator of the LTA is adequately positioned relative to the tubular so that the LTA elevator can be operated to engage the tubular in a subsequent step 510. Thereafter, the TMRT is raised and the LTA and tubular are rotated into or towards the vertical position, substantially coaxial with the TMRT, in a step 515.

The TMRT is then lowered during a step 520 such that the tubular is stabbed into or otherwise interfaced with the stump (existing tubular string suspended within the wellbore by floor slips and extending a short distance above the rig floor), or a plate or other structure over the stump, or any other load-bearing structure to urge the tubular towards the TMRT. In a subsequent step 525, the TMRT is further lowered, or the tubular raised relative to the TMRT, to engage the upper end of the tubular with the gripping mechanism within the TMRT. The running tool is then preferably moved away from the load-bearing surface, preferably in an upwards direction, to cause the engaged gripping elements to grip the tubular. Alternatively, or during an optional but preferred step 530, a pre-load and/or other force may then be applied to the tubular as discussed herein, such as to "set" the gripping mechanism within the TMRT and thereby rigidly engage and grip the tubular with the gripping mechanism. The TMRT may then be rotated during a step 535 to make up the connection between the tubular and the stump.

The method 500 then typically proceeds to step 540 during which the TMRT can be raised a short distance if needed to release the floor slips and then lowered to position the tubular as the new stump. In a subsequent step 545, the gripping mechanism of the TMRT may be disengaged to decouple the tubular as discussed herein, and the TMRT may be raised in preparation for the next iteration of the method 500.

Figure 5B:
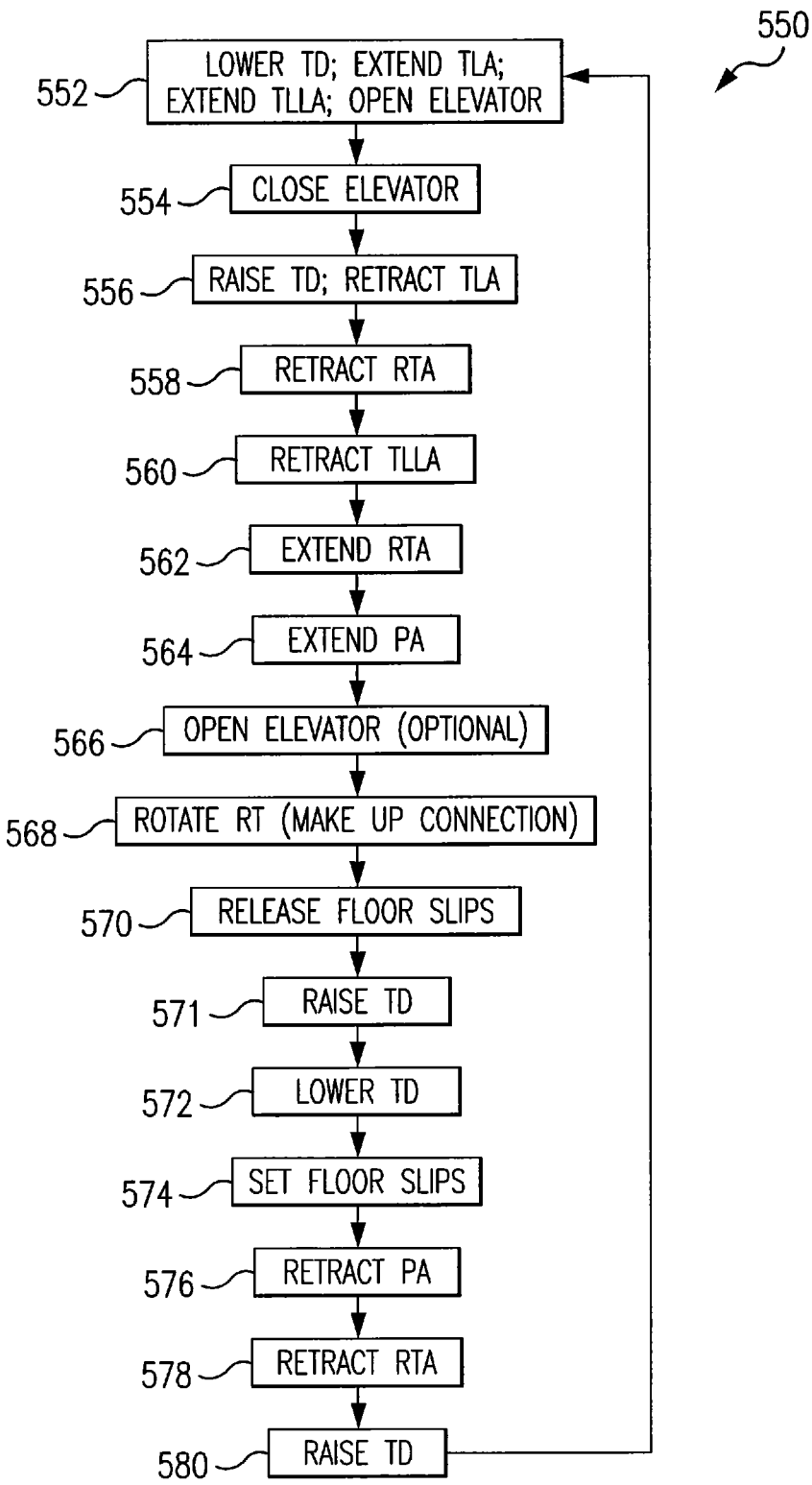
FIG. 5B is a flow-chart diagram of at least a portion of a method according to one or more aspects of the present disclosure.

Referring to FIG. 5B, illustrated is a flow-chart diagram of at least a portion of a method 550 according to one or more aspects of the present disclosure. The method 550 may be substantially similar to the method of operation depicted in FIGS. 1A-G, 3A-D, and 5A, and/or may include alternative or optional steps relative to the method depicted in FIGS. 1A-G, 3A-D, and 5A. For example, the method 550 may be performed to add one or more tubulars (singles, doubles, or triples) to an existing drill string that is suspended within a wellbore. The system 400 shown in FIG. 4 depicts an exemplary environment in which the method 550 may be implemented.

The method 550 includes a step 552 during which the top drive (TD) is lowered, the tilt link actuator (TLA) is extended, the tilt link load actuator (TLLA) is extended, and the tubular elevator member is opened. Two or more of these actions may be performed substantially simultaneously or, alternatively, step 552 may comprise performing these actions in series, although the particular sequence or order of these actions of step 552 may vary within the scope of the present disclosure. The actions of step 552 are configured to orient the elevator relative to the tubular being installed into the string such that the elevator can subsequently engage the tubular.

The TD may be or comprise a rotary drive supported above the rig floor, such as the rotary drive 440 shown in FIG. 4. The TLA comprises one or more components which tilt the TLLA and elevator out of vertical alignment with the TD, such as the actuators 160 shown in FIGS. 1A-G. The TLLA comprises one or more components which adjust the vertical position of the elevator relative to the TD, such as the actuators 150 shown in FIGS. 1A-G. The elevator may be or comprise a grasping element configured to engage the tubular being assembled into the drill string, such as the tubular member elevator 120 shown in FIGS. 1A-G and 3A-D.

After orienting the elevator relative to the new tubular by operation of the TD, TLA, and TLLA, as achieved by the performance of step 552, step 554 is performed to close the elevator or otherwise engage the new tubular with the elevator. Thereafter, step 556 is performed, during which the TD is raised and the TLA is retracted. The actions of raising the TD and retracting the TLA may be performed substantially simultaneously or serially in any sequence. The TD is raised a sufficient amount such that the lower end of the new tubular is positioned higher than the drill string stump protruding from the rig floor, and the retraction of the TLA brings the new tubular into vertical alignment between the stump and the TD.

In a subsequent step 558, the running tool actuator (RTA) is retracted. The RTA may be or comprise a linearly actuated cylinder which is operable hydraulically, electrically, mechanically, pneumatically, or via a combination thereof. The RTA couples to a portion of the running tool (RT) such that the RT is able to grip the tubular when the RTA is extended but is prevented from gripping the tubular when the RTA is retracted.

The TLLA is then retracted during step 560, such that the end of the tubular is inserted into the RT. In a subsequent step 562, the RTA is extended, thereby allowing the RT to grip the tubular. The method 550 also includes a step 564 during which a pre-load actuator (PA) is extended to apply an axial force to the end of the tubular and thus forcibly cause the engagement of the tubular by the RT. The PA comprises one or more components configured to apply an axial force to the end of the tubular within the RT, such as the actuator 320 and/or pre-load mechanism 310 shown in FIGS. 3A-D. The PA may be a plate or cap that is configured to apply force to an end of the tubular in one preferred embodiment.

The method 550 may also include a step 566 during which the elevator may be opened, such that the tubular is only retained by engagement with the RT. However, this action of opening the elevator may be performed at another point in the method 550, or not at all until after the gripping assembly is to be released to lower the RT.

During a subsequent step 568, the RT is rotated such that a connection is made up between the new tubular and the stump. To be clear, this and many of the embodiments discussed herein are with respect to the make-up operation, and these can be reversed to achieve a suitable break-out operation. In the present example, such rotation is driven by the rotational force provided by the top drive. Other mechanisms or means for rotating the RT are also within the scope of the present disclosure so long as the gripping assembly engages and grips the tubular or tubular string, but preferably this rotation occurs at least partially, preferably entirely, through the gripping elements gripping the tubular.

After the connection is made up by performing step 568, the floor slips are released during step 570. The TD is then initially raised during step 571 to fully disengage the stump from the slips, and then lowered during step 572 to translate the newly-joined tubular into the wellbore such that only an end portion of the new tubular protrudes from the rig floor, forming a new stump. The floor slips are then reset to engage the new stump during a subsequent step 574.

Thereafter, the PA can be retracted during step 576, and the RTA can be retracted during step 578, such that the new tubular (the top of which is now the stump) is engaged only by the floor slips and not any portion of the RT or elevator. The TD is then free to be raised during subsequent step 580. As indicated in FIG. 5B, the method 500 may then be repeated to join another tubular to the new stump.

Figure 5C:
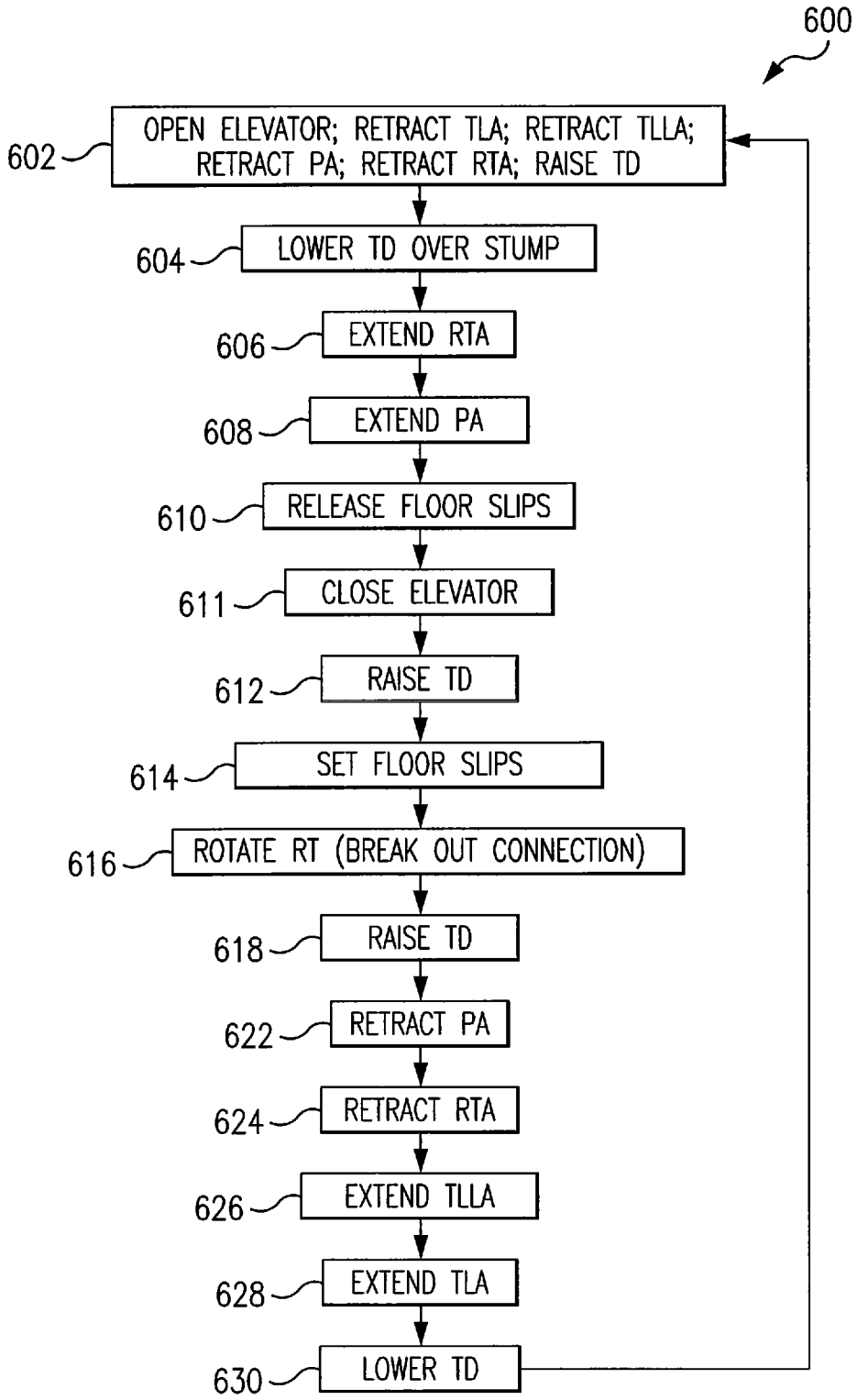
FIG. 5C is a flow-chart diagram of at least a portion of a method according to one or more aspects of the present disclosure.

Referring to FIG. 5C, illustrated is a flow-chart diagram of at least a portion of a method 600 according to one or more aspects of the present disclosure. The method 600 may be substantially similar to a reversed embodiment of the method of operation depicted in FIGS. 1A-G, 3A-D, and 5A-B, and/or may include alternative or optional steps relative to the method depicted in FIGS. 1A-G, 3A-D, and 5A-B. For example, the method 600 may be performed to remove one or more tubulars (singles, doubles, or triples) from an existing drill string that is suspended within a wellbore. The system 400 shown in FIG. 4 depicts an exemplary environment in which the method 600 may be implemented.

The method 600 includes a step 602 during which the elevator is opened, the TLA is retracted, the TLLA is retracted, the PA is retracted, the RTA is retracted, and the TD is raised. Two or more of these actions may be performed substantially simultaneously or, alternatively, step 602 may comprise performing these actions in series, although the particular sequence or order of these actions of step 602 may vary within the scope of the present disclosure. The actions of step 602 are configured to orient the elevator and RT relative to the protruding end (stump) of the tubular being removed from the drill string such that the RT can subsequently engage the tubular.

Thereafter, during step 604, the TD is lowered over the stump, such that the stump is inserted into the RT. The RTA is then extended during step 606, and the PA is then extended during step 608. Consequently, the stump is engaged and gripped by the RT. The floor slips are then released during step 610. During step 611, the elevator is closed to engage and grip the removed tubular, which is still engaged and gripped by the RT. The TD is subsequently raised during step 612, such that the entire length of the tubular being removed from the drill string is raised above the rig floor and the end of the next tubular in the drill string protrudes from the wellbore. The floor slips are then reset to engage and grip the next tubular during step 614. In a subsequent step 616, the RT is rotated to break out the connection between the tubular being removed and the next tubular that will form the new stump. After breaking the connection, the TD is raised during step 618, thereby lifting the tubular off of the new stump.

The PA is then retracted during step 622, and the TLLA is then retracted during step 624, such that the tubular can be released from gripping and become disengaged from the RT, yet it is still engaged and gripped by the elevator.

The TLLA is then extended during step 626. Because the tubular is no longer engaged or gripped by the RT, the extension of the TLLA during step 626 pulls the tubular out of the RT. However, step 626 may include or be proceeded by a process to fully disengage the RT from the tubular, such as by lowering the TD to lightly set the removed tubular down onto the stump or a protective plate positioned on the stump, after which the TD is raised once again so that the removed tubular vertical clears the stump.

Thereafter, the TLA is extended during step 628 to tilt the removed tubular (currently engaged and gripped by the elevator) away from vertical alignment with the TD. The TD is then lowered during step 630. The steps 628 and/or 630 may be performed to orient the removed tubular relative a pipe rack or other structure or mechanism to which the tubular will be deposited when the elevator is subsequently opened. The method 600 may further comprise an additional step during which the elevator is opened once the tubular is adequately oriented. Alternatively, iteration of the method 600 may be performed such that the removed tubular is deposited on the pipe rack or other structure or mechanism when the elevator is opened during the second iteration of step 602. As indicated in FIG. 5C, the method 600 may be repeated to remove additional tubulars from the tubular string.

Figure 6:
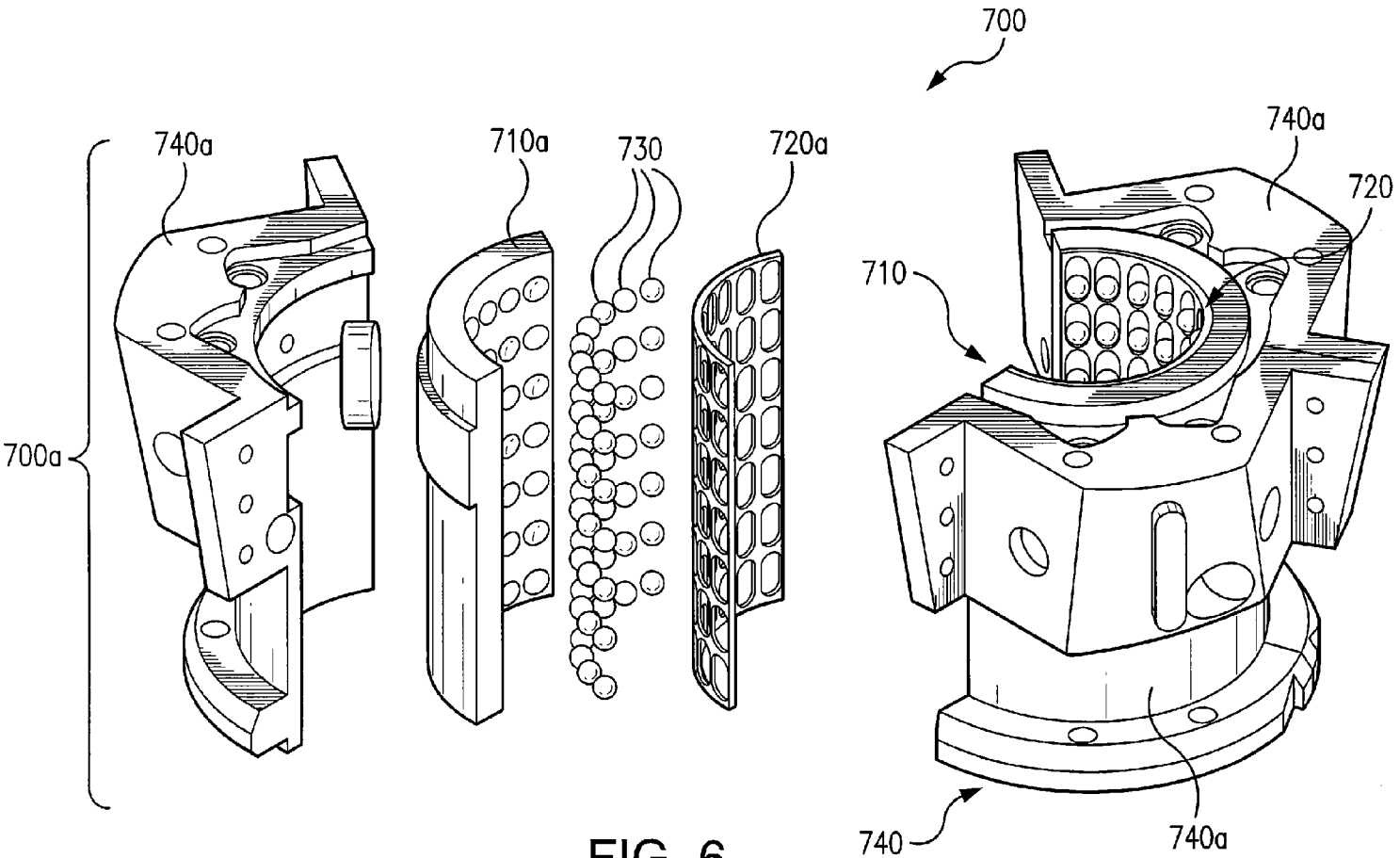
FIG. 6 is a sectional view of a portion of an embodiment of the apparatus shown in FIG. 2.

Referring to FIG. 6, illustrated is an exploded perspective view of at least a portion of an exemplary embodiment of the gripping mechanism of the RT 110 shown in FIGS. 1A-G, 2, and 3A-D, herein designated by the reference numeral 700. One or more aspects of the gripping mechanism 700 is substantially similar or identical to one or more corresponding aspects of the gripping mechanism of the RT 110 shown in FIGS. 1A-G, 2, and 3A-D. In an exemplary embodiment, the apparatus 700 shown in FIG. 6 is substantially identical to at least a portion of the RT 110 shown in FIGS. 1A-G, 2, and/or 3A-D.

The apparatus 700 includes a recessed member 710, a perforated member 720 whose apertures may be round or elongated, and a plurality of rolling or sliding members 730. One or more aspects of the recessed member 710 is substantially similar or identical to one or more corresponding aspects of the recessed member 210 shown in FIG. 2. One or more aspects of the perforated member 720 is substantially similar or identical to one or more corresponding aspects of the slotted member 220 shown in FIG. 2. The rolling or sliding members 730 may be substantially identical to the rolling or sliding members 230 shown in FIG. 2.

As shown in FIG. 6, however, the recessed member 710 and the slotted member 720 each comprise three discrete sections 710*a*, 720*a*, respectively. The apparatus 700 also includes in this embodiment a holder 740 which also comprises three discrete sections 740*a*. Other functionally equivalent configurations may combine section 740*a* and 710*c* to create an integral member. Each holder section 740*a* may include two flanges 745, each of which is configured to be coupled with a flange 745 of another of the holder sections 740*a*, such that the holder sections 740*a* may be assembled to form a bowl-type structure (holder 740) configured to hold the sections 710*a* of the recessed member 710, the sections 720*a* of the slotted member 720, and the rolling or sliding members 730.

Figure 7A:
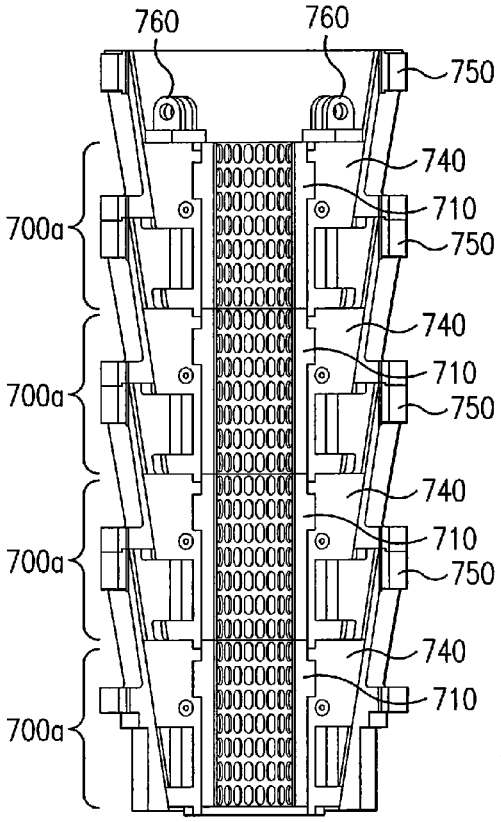
FIGS. 7A and 7B are perspective views of an embodiment of the apparatus shown in FIG. 6.
Figure 7B:
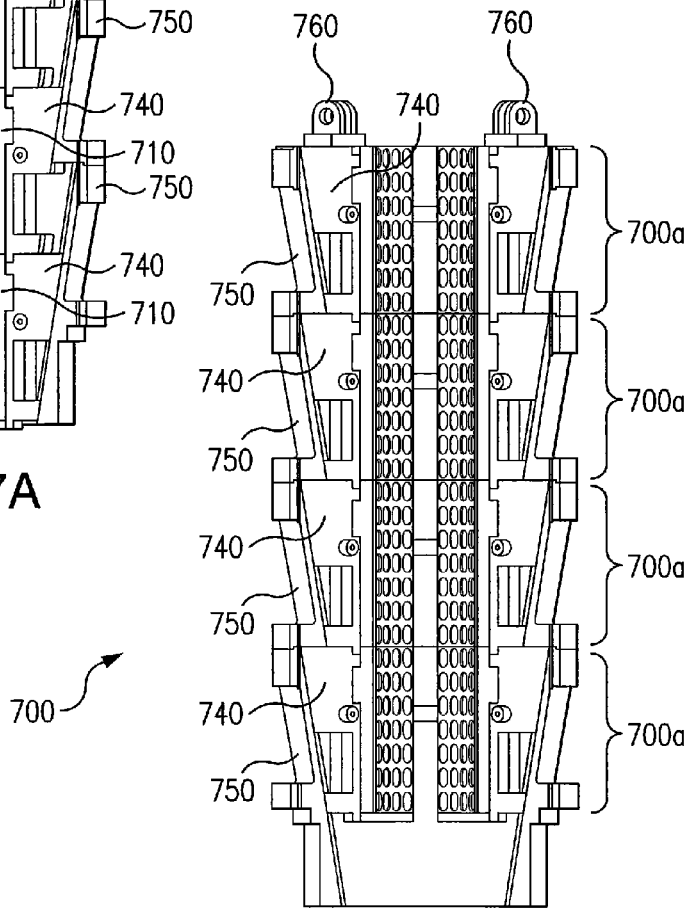

FIGS. 7A and 7B are perspective views of the apparatus 700 shown in FIG. 6 in engaged and disengaged positions, respectively. Referring to FIGS. 7A and 7B collectively, with continued reference to FIG. 6, the apparatus 700 may include multiple segments 700*a* stacked vertically. In the exemplary embodiment shown in FIGS. 7A and 7B, the apparatus 700 includes four vertical segments 700*a*. In other embodiments, however, the apparatus 700 may include fewer or more segments. The gripping force applied by the apparatus 700 to the tubular is at least partially proportional to the number of vertical segments 700*a*, such that increasing the number of vertical segments 700*a* increases the lifting capacity of the apparatus 700 as well as the torque which may be applied to the tubular by the apparatus 700. Each of the vertical segments 700*a* may be substantially similar or identical, although the top and bottom segments 700*a* may have unique interfaces for coupling with additional equipment between the top drive and the casing string.

The external profile of each holder 740 is tapered, such that the lower end of each holder 740 has a smaller diameter than its upper end. Each vertical segment 700*a* of the apparatus 700 also includes a housing 750 having an internal profile configured to cooperate with the external profile of the holder 740 such that as the holder 740 moves downward (relative to the housing 750) towards the engaged position (FIG. 7A) the holder 740 constricts radially inward, yet when the holder 740 moves upward towards the disengaged position (FIG. 7B) the holder 740 expands radially outward. The housing 750 is also referred to as a ramp or ramp structure in the present application.

The top segment 700*a* of the apparatus 700 may include an interface 760 configured to couple with one or more hydraulic cylinders and/or other actuators (not shown). Moreover, each holder 740 is coupled to its upper and lower neighboring holders 740. Consequently, vertical movement urged by the one or more actuators coupled to the interface 760 results in simultaneous vertical movement of all of the holders 740. Accordingly, downward movement of the holders 740 driven by the one or more actuators causes the gripping elements 730 to engage and grip the outer surface of the tubular, whereas upward movement of the holders 740 driven by the one or more actuators causes the gripping elements 730 to release and then disengage from the tubular. The force applied by the one or more actuators to drive the downward movement of the holders 740 to engage the gripping elements 730 with the tubular and cause frictional retention thereof is one example of the pre-load or other force described above with regard to step 530 of the method 500 shown in FIG. 5A, the step 564 shown in FIG. 5B, and/or the step 608 shown in FIG. 5C. The holders 740 may be open-faced, e.g., to minimize their weight, as shown in FIGS. 6, 7A and 7B, but in other embodiments (not shown) may be closed-face so as to accommodate load-bearing and weight distribution requirements or preferences.

In one preferred embodiment in the make-up aspect according to the invention, the gripping elements may be moved initially in an angled downward direction towards a tubular to engage (or contact) the tubular, which has been disposed in a recess in the running tool, typically by operation of the tubular elevator member. The gripping elements will typically inherently be pulled downwards in their corresponding recesses by gravity until they either reach the shallow end of the recess or contact the tubular. As the tubular and the gripping assembly are moved towards each other, the gripping elements in the gravity-fed embodiment will be forced further towards the shallow end of each recess by gravity and therefore radially towards the tubular to grip it, but towards the deeper end of each recess by contact of the tubular therewith. Eventually, the movement of the gripping elements, typically downwards in part and always radially towards the tubular, will be the stronger force and the gripping elements will move to a sufficiently shallow part of the recess to grip the tubular. As discussed herein, the weight of the tubular will cause gripping even without providing power or actuation to the engaged gripping elements, but preferably a pre-load axial force is applied to the tubular to increase the gripping strength of the gripping assembly. By moving the tubular and running tool apart from each other once the tool engages the tubular, it is contemplated this can be done in any available manner, such as having the elevator simply release the tubular into free-fall, or by having the elevator move downwards to pull the tubular downwards, by applying an actuator at the end or along another radius of the tubular (e.g., the pre-load noted herein), or the like, or any combination thereof, so as to cause the tubular to be gripped by the engaged gripping elements. After make-up, the gripping elements are pulled away from the shallow end or adjacent thereto towards the deeper end of their respective recesses by a release pressure or force that is sufficient to cause the gripping assembly to release from gripping. In one embodiment where the gripping occurs on an outside surface of the tubular, the gripping assembly or at least the slotted member is lifted from the gripping position so that radial portions can be separated, e.g., through a spring-loaded mechanism between radial wedges so that the larger end collar of the tubular can be released through the gripping assembly. Thus, the gripping elements of this embodiment typically move upwards and radially away from the gripping position adjacent the previously-held tubular to release the tubular to a merely engaged position with no gripping and then to a fully released position. It should be understood that the break-out version operates in an essentially reversed manner by taking off one tubular from the string, having the tubular elevator grip it, then releasing the gripping assembly, etc. Other release operations can be conducted as described herein, such as by moving a sliding slotted member to release the gripping elements particularly when the gripping occurs on an inner surface of a tubular.

In view of all of the above and the exemplary embodiments depicted in FIGS. 1A-1G, 2, 3A-D, 4, 5A-C, 6, 7A and 7B, it should be readily apparent that the present disclosure introduces various embodiments as follows, including an apparatus adapted to handle a tubular, comprising: a tubular running tool; a tubular member elevator; a plurality of first actuators each extending between the running tool and the elevator; and optionally a plurality of second actuators each extending between the running tool and a corresponding one of the first actuators, wherein each of the actuators is independently hydraulically- or electrically-operable. The running tool comprises: a slotted or perforated member having a plurality of apertures which may be elongated slots each extending in a direction; a recessed member fixed, rotatably, radially expandably or contractably, or slidably, coupled to the slotted member and having a plurality of recesses each tapered in the direction from a shallow end to a deep end; and a plurality of rolling or sliding members (or gripping elements) each retained between one of the plurality of recesses and one of the plurality of apertures. Each of the plurality of gripping elements partially extends through an adjacent one of the plurality of elongated slots when located in the shallow end of the corresponding one of the plurality of recesses, and each of the plurality of gripping elements retracts to within an outer perimeter of the slotted member, or preferably partially within the outer perimeter so as to extend less, when displaced from the shallow end toward a deep end of the corresponding one of the plurality of recesses.

The elevator may comprise: a slotted elevator member having a plurality of apertures which may be elongated slots each extending in a direction; a recessed elevator member slidably coupled to the slotted elevator member and having a plurality of recesses each tapered in the direction from a shallow end to a deep end; and a plurality of rolling elevator members each retained between one of the plurality of recesses and one of the plurality of elongated slots. Each of the plurality of rolling elevator members partially extends through an adjacent one of the plurality of elongated slots when located in the shallow end of the corresponding one of the plurality of recesses, and each of the plurality of rolling elevator members retracts to within an outer perimeter of the slotted elevator member when located in a deep end of the corresponding one of the plurality of recesses. A floor slip including a substantially similar gripping apparatus for gripping a tubular string may be provided, preferably in association with the RT, but preferably adapted to hold the entire tubular string without further support.

The running tool may be configured to frictionally engage an outer surface of the tubular sufficient to apply a torque to the tubular. In an exemplary embodiment, the torque is at least about 5000 ft-lbs. In another exemplary embodiment, the torque is at least about 50,000 ft-lbs.

In one embodiment, each first actuator may comprise a first cylinder having a first end and a second end, wherein the first end is rotatably coupled to a first attachment point of the running tool, and wherein a first rod extends from the second end and is rotatably coupled to the elevator. Each second actuator may comprise a second cylinder having a first end and a second end, wherein the first end of the second cylinder is rotatably coupled to a second attachment point of the running tool, and wherein a second rod extends from the second end of the second cylinder and is rotatably coupled to the first cylinder.

The tubular may be selected from the group consisting of: a wellbore casing member; a drill string tubing member; a pipe member; and a collared tubing member. The running tool may be configured to frictionally engage the tubular, wherein a portion of the running tool forms a fluidic seal with an end of the tubular when the running tool is engaged with the tubular.

The apparatus may further comprise a controller in communication with the running tool, the elevator, and the first and second actuators. The controller may be configured to substantially automate operation of the elevator and the first and second actuators during engagement of the elevator and the tubular. Thus automation may include but is not limited to the counting of rotations, the measurement and application of torque, and the control of the rotations per unit of time of the apparatus, among other possible automated aspects. The elevator may be configured to engage an outer surface of an axially-intermediate portion of the tubular. The controller may be configured to substantially automate operation of the running tool, the elevator, and the first and second actuators during engagement of the running tool and the tubular. The running tool may be configured to engage and grip an outer surface of another axially-intermediate portion of the tubular.

The present disclosure also introduces a method of handling a tubular, comprising: engaging an outer surface of an axially-intermediate portion of the tubular with a tubular member elevator, and operating a plurality of links extending between the elevator and a tubular running tool to thereby position an end of the tubular within the running tool. The method further comprises engaging an outer surface of another portion of the tubular with the running tool, including applying an axial force to the end of the tubular within the running tool. Applying an axial force to the end of the tubular may comprise actuating a hydraulic cylinder or other hydraulic or electric device to move a recessed member of a gripping mechanism relative to a housing of the gripping mechanism, thereby causing a plurality of rolling or sliding members of the gripping mechanism to each engage the tubular.

The method may further comprise disengaging the tubular member elevator from the tubular; and disengaging the running tool from the tubular. Disengaging the running tool from the tubular may comprise removing the axial force applied to the end of the tubular within the running tool. The method may further comprise rotating the tubular by rotating the running tool while the tubular is engaged by the running tool, including applying a torsional force to the tubular, wherein the torsional force is not less than about 5000 ft-lbs.

The present disclosure also provides an apparatus for handling a tubular, comprising: means for engaging an outer surface of an axially-intermediate portion of the tubular; means for positioning the engaging means to thereby position an end of the engaged tubular within a running tool; and means for applying an axial force to the end of the tubular within the running tool to thereby engage an outer surface of another portion of the tubular with the running tool.

The ability to grip a tubular at a position distal from the end (e.g., within an intermediate portion defined by a gripping limit), coupled with the ability to lift the tubular without damaging the tubular, and subsequently insert the tubular into a handling tool, all with no or minimal human handling of the tubular, is something that has not been done before, and satisfies and long-felt need in industry. One or more aspects of the present disclosure may facilitate gripping techniques which may allow an elevator to grip and lift or lower a tubular without damaging its sensitive outer surface. One or more aspects of the present disclosure may also significantly improve the time it takes to add each new tubular into the wellbore string, such as may be due to reducing the process time previously required for evaluating and handling each tubular and making the connections. The cycle time per tubular tripped in or out can be as low as about 2 minutes to about 4 minutes, typically as low as about 2.5 minutes to about 3 minutes. However, other benefits and advantages may also be within the scope of the present disclosure.

The foregoing outlines features of several embodiments so that those of ordinary skill in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those of ordinary skill in the art should also realize that such equivalent constructions do not depart from the spirit and scope of the present disclosure, and that they may make various changes, substitutions and alterations herein without departing from the spirit and scope of the present disclosure.

What is claimed is:

1. A tubular handling apparatus, comprising:

a tubular running tool comprising:

a slotted member having a plurality of elongated slots each extending at least partially in a direction substantially parallel to a longitudinal axis of a tubular to be handled;

recessed member operably associated with the slotted member and having a plurality of recesses in a surface thereof that each extend between a deep end and a shallow end; and a plurality of sliding members operatively associated with the plurality of elongated slots and the plurality of recesses, and adapted to move in the same direction as a tubular in contact therewith so that the tool grips the tubular;

a tubular member elevator adapted to operatively associate a tubular with the tubular running tool;

a pre-load mechanism that is adapted to reversibly exert force on the axial end of the tubular when engaged in the tubular running tool so as to grip the tubular; and wherein the tubular running tool is adapted to grip each tubular to provide load-bearing capacity to inhibit or prevent the tubular or a tubular string attached thereto from dropping independently of the operation of the tubular member elevator.

2. The tubular handling apparatus of claim 1, wherein the tubular member elevator is coupled to the tubular running tool and is adapted to transfer tubulars between a tubular supply and the tubular running tool.

3. The tubular handling apparatus of claim 2, wherein the tubular running tool and tubular member elevator are coupled through no more than a pair of actuators.

4. The tubular handling apparatus of claim 3, wherein the no more than a pair of actuators is operably associated with linking elements that facilitate positioning of a portion of the tubular within the tubular running tool.

5. The tubular handling apparatus of claim 1, wherein the plurality of sliding members each retracts at least partially into a corresponding recess when the tubular handling apparatus is in a gripping position to grip a tubular.

6. A tubular running tool comprising:

a slotted member having a plurality of elongated slots each extending at least partially in a direction substantially parallel to a longitudinal axis of a tubular to be handled;

a recessed member operably associated with the slotted member having a plurality of recesses wherein the recesses extend from a deep end to a shallow end; and a plurality of sliding members operatively associated with the plurality of elongated slots and the plurality of recesses;

a pre-load mechanism that is adapted to reversibly exert force on the axial end of the tubular when engaged in the tubular running tool so as to grip the tubular; and wherein a gripping portion of the running tool is configured to frictionally engage at least one surface of a tubular sufficient to apply a torque to the tubular solely through the gripping portion.

7. The tubular running tool of claim 6, wherein the plurality of elongated slots are fixed relative to the plurality of recesses.

8. The tubular running tool of claim 6, wherein the running tool is configured to frictionally engage an inner surface of a tubular.

9. The tubular running tool of claim 6, wherein the plurality of sliding members each retract partially into a corresponding slot and recess when the tubular handling apparatus is in a release position so as not to grip a tubular.

10. The tubular running tool of claim 6, wherein the plurality of sliding members are adapted to grip a tubular upon the motion of the tubular away from the running tool.

11. The tubular running tool of claim 6, wherein the tubular running tool is operatively associated with a handling mechanism that is adapted to feed a tubular into, or remove a tubular from, the running tool so as to facilitate iterative loading of the running tool with a further tubular.

* * * * *

UNITED STATES PATENT AND TRADEMARK OFFICE

CERTIFICATE OF CORRECTION

PATENT NO. : 8,720,541 B2
APPLICATION NO. : 12/982644
DATED : May 13, 2014
INVENTOR(S) : Brian Ellis et al.

It is certified that error appears in the above-identified patent and that said Letters Patent is hereby corrected as shown below:

Title Page item (63), under Related U.S. Application Data should read:

--Continuation-in-part of application No. 12/147,223, filed on Jun. 26, 2008, now Pat No. 8,074,711--

Signed and Sealed this
Fifth Day of August, 2014

Michelle K. Lee

Michelle K. Lee
*Deputy Director of the United States Patent and Trademark Office*